US010512354B2

(12) United States Patent
Chen

(10) Patent No.: US 10,512,354 B2
(45) Date of Patent: Dec. 24, 2019

(54) MODULAR TREE WITH ELECTRICAL CONNECTOR

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 16/039,132

(22) Filed: Jul. 18, 2018

(65) Prior Publication Data

US 2019/0008305 A1 Jan. 10, 2019

Related U.S. Application Data

(63) Continuation of application No. 15/596,421, filed on May 16, 2017, now Pat. No. 10,028,607, which is a (Continued)

(51) Int. Cl.
*F21S 6/00* (2006.01)
*A47G 33/06* (2006.01)

(Continued)

(52) U.S. Cl.
CPC ..... *A47G 33/06* (2013.01); *A41G 1/005* (2013.01); *A41G 1/007* (2013.01); *A47G 33/08* (2013.01);

(Continued)

(58) Field of Classification Search
CPC ..... A47G 33/06; A47G 33/08; F21S 2/005; F21V 23/02; F21V 33/0028; H01R 31/00; H01R 2103/00; F21W 2121/04
See application file for complete search history.

(56) References Cited

U.S. PATENT DOCUMENTS 4,020,201 A * 4/1977 Miller ..... A47G 33/06 428/8
6,457,839 B1 * 10/2002 Grandoit ..... A47G 33/06 362/122

(Continued)

OTHER PUBLICATIONS

Opinion, United States Court of Appeals for the Federal Circuit, *Polygroup Limited MCO* v. *Willis Electric Company, Ltd.* , Appeal Nos. 2018-1745, 2018-1746, 2018-1747, 18 pages (Jan. 28, 2019).

(Continued)

*Primary Examiner* — Ali Alavi
(74) *Attorney, Agent, or Firm* — Christensen, Fonder, Dardi & Herbert PLLC

(57) ABSTRACT

A lighted artificial tree, including a first tree portion having a first electrical connector having a first electrical terminal positioned in line with a central vertical axis, and a second electrical terminal. The tree also includes a second tree portion that includes a second electrical connector having a first electrical terminal and a second electrical terminal, the second electrical terminal defining a ring shape that encircles the first electrical terminal. When the first tree portion is coupled to the second tree portion, the first electrical connector is coupled to the second electrical connector, such that the first electrical terminal of the first electrical connector is electrically connected to the first electrical terminal of the second electrical connector, and the second electrical terminal of the first electrical connector is electrically connected to the second electrical terminal of the second electrical connector.

27 Claims, 13 Drawing Sheets

Related U.S. Application Data continuation of application No. 15/350,707, filed on Nov. 14, 2016, now Pat. No. 10,010,208, which is a continuation of application No. 14/725,972, filed on May 29, 2015, now Pat. No. 9,526,286, which is a continuation of application No. 13/836,026, filed on Mar. 15, 2013, now Pat. No. 9,044,056.

(60) Provisional application No. 61/643,968, filed on May 8, 2012.

(51) Int. Cl.

| | |
|---|---|
| ***A41G 1/00*** | (2006.01) |
| ***F21V 23/06*** | (2006.01) |
| ***F21S 4/10*** | (2016.01) |
| ***F21S 4/00*** | (2016.01) |
| ***A47G 33/08*** | (2006.01) |
| ***F21S 2/00*** | (2016.01) |
| ***F21V 23/00*** | (2015.01) |
| ***F21V 23/02*** | (2006.01) |
| ***F21V 33/00*** | (2006.01) |
| ***H01R 31/00*** | (2006.01) |
| *F21W 121/04* | (2006.01) |
| *F21V 23/04* | (2006.01) |
| *H01R 103/00* | (2006.01) |

(52) U.S. Cl.

CPC ..... *F21S 2/005* (2013.01); *F21S 4/001* (2013.01); *F21S 4/10* (2016.01); *F21V 23/001* (2013.01); *F21V 23/02* (2013.01); *F21V 23/06* (2013.01); *F21V 33/0028* (2013.01); *H01R 31/00* (2013.01); *A47G 2033/0827* (2013.01); *F21V 23/0407* (2013.01); *F21W 2121/04* (2013.01); *H01R 2103/00* (2013.01)

(56) References Cited

U.S. PATENT DOCUMENTS

| | | | | |
|---|---|---|---|---|
| 6,634,766 | B1 * | 10/2003 | Gordon | F21S 4/10 362/239 |
| 7,270,450 | B2 * | 9/2007 | Chan | A47G 33/06 362/398 |
| 8,053,042 | B1 * | 11/2011 | Loomis | A47G 33/06 362/123 |
| 9,839,315 | B2 * | 12/2017 | Leung | A47G 33/06 |
| 2004/0090770 | A1 * | 5/2004 | Primeau | A47G 33/06 362/123 |

OTHER PUBLICATIONS

Modified Opinion, United States Court of Appeals for the Federal Circuit, *Polygroup Limited MCO* v. *Willis Electric Company, Ltd* , Appeal Nos. 2018-1745, 2018-1746, 2018-1747, 18 pages (Mar. 28, 2019).

Final Written Decision, Patent Trial and Appeal Board, *Polygroup Limited* v. *Willis Electric Co., Ltd.* , Case IPR2016-01613, 43 pages (Feb. 26, 2018).

* cited by examiner

MODULAR TREE WITH ELECTRICAL CONNECTOR

CROSS-REFERENCE TO RELATED APPLICATIONS

The present application is a continuation of U.S. patent application Ser. No. 15/596,421, filed May 16, 2017, which is a continuation of U.S. patent application Ser. No. 15/350,707, filed Nov. 14, 2016, which is a continuation of U.S. patent application Ser. No. 14/725,972, filed May 29, 2015, now U.S. Pat. No. 9,526,286, issued Dec. 27, 2016, which is a continuation of U.S. patent application Ser. No. 13/836,026, filed Mar. 15, 2013, now U.S. Pat. No. 9,044,056, issued Jun. 2, 2015, which claims the benefit of U.S. Provisional Application No. 61/643,968 filed May 8, 2012, all of which are hereby incorporated by reference herein in their entireties.

FIELD OF THE INVENTION

The present invention is generally directed to artificial trees. More specifically, the present invention is directed to artificial trees having separable, modular tree portions electrically connectable between trunk portions.

BACKGROUND OF THE INVENTION

For the sake of convenience and safety, consumers often substitute artificial trees constructed of metal and plastic for natural evergreen trees when decorating homes, offices, and other spaces, especially during the holidays. Such artificial trees generally include multiple tree sections joined at the trunk and held erect by a floor-based tree stand. Traditionally, consumers wrap strings of lights about the artificial tree to enhance the decorative quality of the tree display. As more and more decorative light strings are draped around the tree, it becomes more and more difficult to provide power to the various light strings distributed throughout the tree.

To ease this burden to the consumer, manufacturers have created "pre-lit" artificial trees. Typical pre-lit trees include an artificial tree with multiple standard light strings distributed about the exterior of the tree. Wires of the light string are clipped to branch structures, while plug ends dangle throughout the branches. Generally, multi-purpose decorative light strings are used in pre-lit trees, often limited to 50 or 100 bulb assemblies, with a bladed power plug for insertion into the back outlet of another light string, or insertion into an alternating current (AC) power source.

As the popularity of such pre-lit trees has grown, so to have the bulk and complexity of pre-lit trees. Along with an increase in the number and density of branches of a typical pre-lit tree comes an increase in the number of lights and light strings on the pre-lit tree. This increased number of branches and lights can significantly increase the weight of the pre-lit tree making it difficult to lift and align individual trunk sections when assembling the tree. Further, the increased number of lights per tree, often as high as 1,000 or 1,500 lights, drastically increases the complexity of interconnecting and powering the numerous light strings.

It can be difficult to find and then properly connect the necessary plugs in order to power all of the light strings on the tree. Light strings may be connected to one another within a given tree section, or sometimes between sections, by connecting the strings end to end. Consumers need to be careful to follow the manufacturer's guidelines and not plug too many light strings together end-to-end and surpass the current-carrying capacity of the light string wiring. Due to such limitations, power plugs of the light strings may include receptacles for receiving other power plugs such that the power plugs may be "stacked" together, plugging one into the other. Short extension cords may be strung along the outside of the trunk to carry power to the various interconnected light strings. The result is a complex web of lighting that often requires a consumer to not only interconnect the plugs and receptacles of individual light strings together, but to stack and plug multiple light strings and cords into multiple power outlets.

Some known inventions have attempted to make pre-lit trees more convenient to put together and power. For example, U.S. Pat. No. 1,656,148 to Harris filed Apr. 5, 1926 and entitled "Artificial Christmas Tree" teaches a simple artificial tree with one embodiment having multiple tree sections that join together. The tree includes single bulbs at each end of a branch, with bulb wiring extending from inside a trunk through hollow branches. A bayonet fitting is used to adjoin the sections, a top section having a projecting pin, and a bottom section having an L-shaped bayonet slot. The two sections are coupled by aligning the projection pin with the bayonet slot and rotating to interlock the sections, thereby bringing a pair of spring contacts into alignment with a pair of terminals to make an electrical connection.

Another known artificial tree as described in U.S. Pat. No. 3,970,834 to Smith, filed Dec. 16, 1974 and entitled "Artificial Tree", describes a pre-lit tree made in sections which may be folded for easy storage. The individual tree sections include a threaded male end and a threaded female socket end. The male end of a tree section is screwed into the female end of another section. Wiring for the lights passes from the trunk through holes in branches and connects with individual lights at an interior of the branch. When the tree is screwed together, an electrical connection is made.

However, such known trees still require significant manipulation and handling of the tree sections to securely align and couple the sections together. Further, such known trees fail to disclose mechanical coupling and electrical connection devices and methods that meet the needs of generally larger, heavier artificial trees with complex lighting systems with large numbers of lights. This is especially true of such artificial trees that are powered by an alternating current (AC) power supply.

SUMMARY

In an embodiment, the claimed invention comprises a lighted artificial tree that includes: a first tree portion aligned along a central vertical axis, the first tree portion including: a first trunk body having a first end, a second end, a first electrical connector positioned in the second end of the first trunk body and including a first electrical terminal positioned in line with the central vertical axis, and a second electrical terminal. The tree also includes a second tree portion aligned with the central vertical axis, the second tree portion including: a second trunk body including a first end and a second end, the first end configured to couple with the second end of the first trunk body of the first tree portion; a second electrical connector positioned in the first end of the second trunk body and including a first electrical terminal and a second electrical terminal, the second electrical terminal defining a ring shape that encircles the first electrical terminal, the second electrical connector configured to couple with the first electrical connector of the first trunk body; and a light string electrically connected to the first and the second electrical terminals of the second electrical connector. Upon the first tree portion being coupled to the second tree portion along the central vertical axis, the first electrical connector is coupled to the second electrical connector, such that the first electrical terminal of the first electrical connector is electrically connected to the first electrical terminal of the second electrical connector, and the second electrical terminal of the first electrical connector is electrically connected to the second electrical terminal of the second electrical connector.

In another embodiment, the claimed invention comprises a lighted artificial tree, comprising a first tree portion and a second tree portion. The first tree portion is aligned along a central vertical axis and includes: a first trunk body having a first end, a second end, a first electrical connector positioned in the second end of the first trunk body and including a first electrical terminal, a second electrical terminal, and a third electrical terminal. The second tree portion is also aligned with the central vertical axis and includes: a second trunk body including a first end and a second end, the first end configured to couple with the second end of the first trunk body of the first tree portion; a second electrical connector positioned in the first end of the second trunk body and including a first electrical terminal, a second electrical terminal, and a third electrical terminal; a light string electrically connected to the second electrical connector. Upon the first tree portion being coupled to the second tree portion along the central vertical axis, the first electrical connector is coupled to the second electrical connector, such that the first electrical terminal of the first electrical connector is electrically connected to the first electrical terminal of the second electrical connector, the second terminal of the first electrical connector is electrically connected to the second electrical terminal of the second electrical connector, and the third electrical terminal of the first electrical connector is electrically connected to the third electrical terminal of the second electrical connector.

In yet another embodiment, the claimed invention comprises a lighted artificial tree that includes: a first trunk body having a first trunk wall and a first electrical wiring harness assembly comprising: a first electrical connector positioned substantially within the first trunk body and including a first electrical terminal and a second electrical terminal; a first wiring harness positioned at least in part within the first trunk body and comprising a first wire and a second wire, the first wire electrically connected to the first electrical terminal and the second wire electrically connected to the second electrical terminal. The tree also includes a first light string having a first wire, a plurality of intermediate wires, a plurality of light element assemblies, and a last wire, a first end of the first wire being electrically connected to the first wire of the first wiring harness, a second end of the first wire being electrically connected to a first light element assembly of the plurality of light element assemblies, each of the intermediate wires being electrically connected at a first end to one of the plurality of light element assemblies and electrically connected at a second end to another of the plurality of light element assemblies, and a last wire electrically connected to a last light element assembly of the plurality of light element assemblies at a first end and electrically connected to the second wire of the first wiring harness at a second end.

In yet another embodiment, the claimed invention comprises a lighted artificial tree, that includes a power cord configured to receive electrical power from an external power source; a first tree portion aligned along a central vertical axis, the first tree portion including: a first trunk body having a first end, a second end, a first electrical connector positioned in the second end of the first trunk body and including a first electrical terminal and a second electrical terminal, the first and second electrical terminals electrically connected to the power cord; and a second tree portion aligned with the central vertical axis, the second tree portion including: a second trunk body including a first end and a second end, the first end configured to couple with the second end of the first trunk body of the first tree portion; a second electrical connector positioned in the first end of the second trunk body and including a first electrical terminal and a second electrical terminal; an electrical hub positioned inside the second trunk body and electrically connected to the first and second electrical connectors of the second electrical connector; a first light string electrically connected to the electrical hub; a second light string electrically connected to the electrical hub. Upon the first tree portion being coupled to the second tree portion along the central vertical axis, the first electrical connector is coupled to the second electrical connector, such that the first electrical terminal of the first electrical connector is electrically connected to the first electrical terminal of the second electrical connector, and the second electrical terminal of the first electrical connector is electrically connected to the second electrical terminal of the second electrical connector, thereby electrically connecting the power cord to the electrical hub and the first and second light strings.

BRIEF DESCRIPTION OF THE FIGURES

The invention can be understood in consideration of the following detailed description of various embodiments of the invention in connection with the accompanying drawings, in which.

Figure 1:
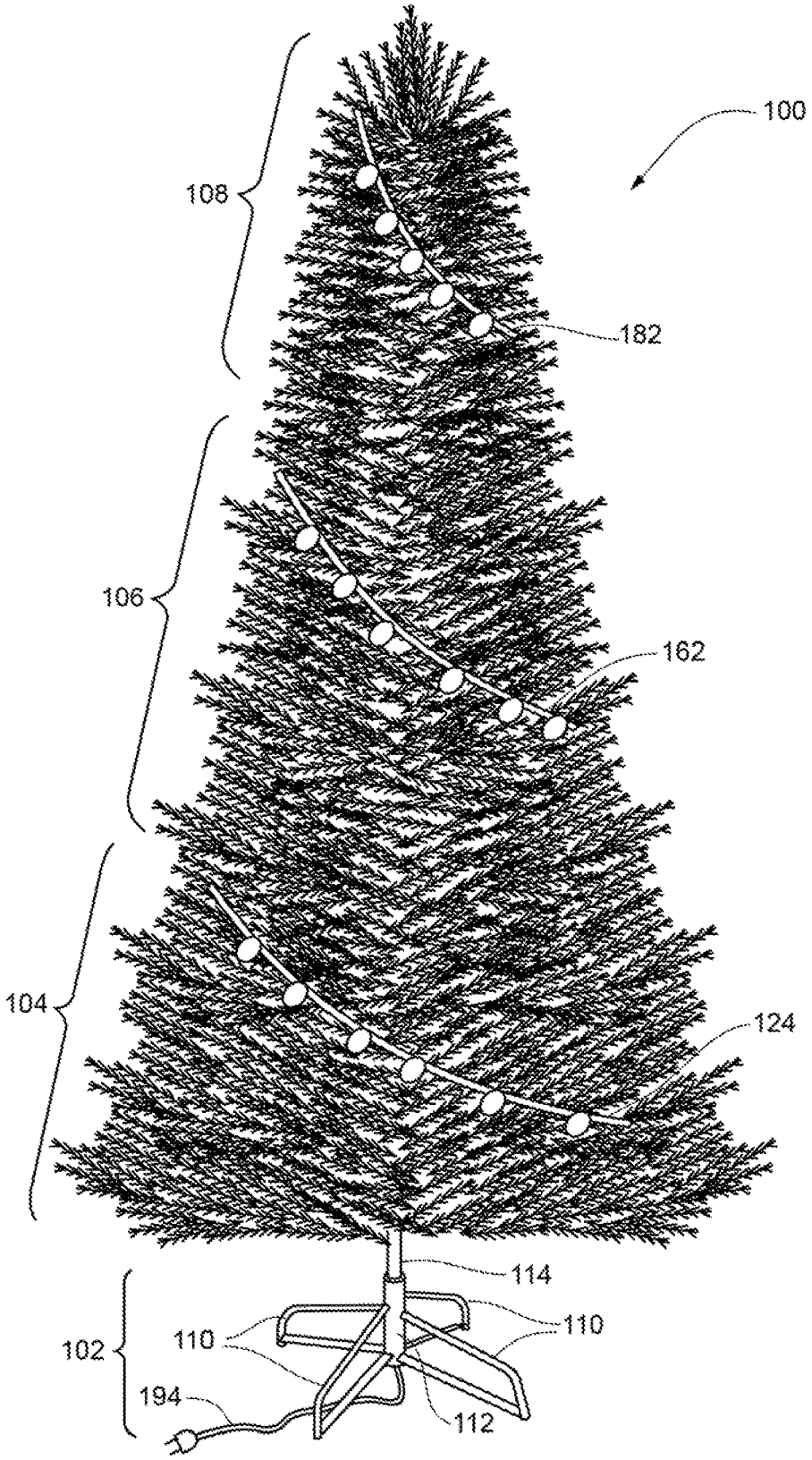
FIG. 1 is a front perspective view of a modular, lighted artificial tree, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Embodiments of the claimed invention include lighted artificial trees with a variety of unique features, including mechanical and electrical trunk connection systems, multi-terminal electrical connectors, trunk wiring harnesses, and "single-wire" light strings.

Referring to FIG. 1, an embodiment of modular lighted tree 100 of the present invention is depicted. Modular tree 100 includes base portion 102, first lighted tree portion 104, second lighted tree portion 106, and third lighted tree portion 108. In some embodiments, modular tree 100 may include more tree portions, such as a fourth tree portion, or may include fewer lighted tree portions. The depicted embodiment of modular tree 100 includes light strings, as described further below, but in other embodiments, modular tree 100 is not a lighted tree. When tree 100 is assembled, as depicted, tree portions 104, 106, and 108 are aligned along a common vertical axis A (see FIG. 2) and held in a generally vertical orientation by base portion 102.

Base portion 102 as depicted includes multiple legs 110 connected to a central trunk-support portion 112. As depicted, trunk support portion 112 may be generally cylindrical to receive and support first tree portion 104. Base portion 102 may include an optional base-trunk portion 114 extending upwardly from trunk support portion 112 to form a portion of a trunk of tree 100. In other embodiments, base portion 102 may comprise other configurations capable of supporting and aligning tree portions 104, 106, and 108 in a steady, upright manner. Such alternate embodiments include a base portion having more or fewer legs 110, an integrated structure with an opening for receiving first lighted tree portion 104, and other such embodiments.

Figure 2:
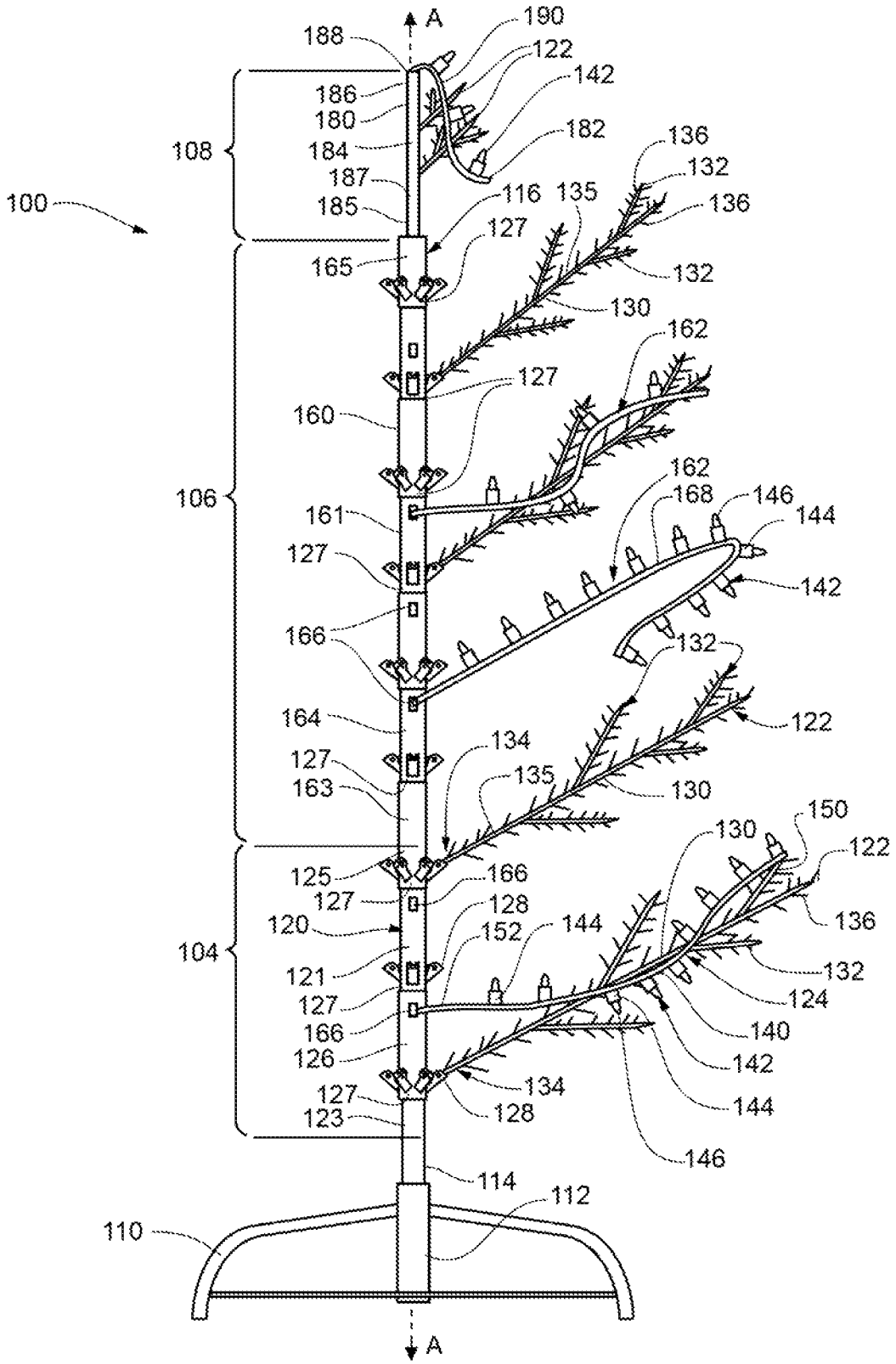
FIG. 2 is a front view of the tree of FIG. 1, with multiple branches removed.

Referring also to FIG. 2, modular tree 100 is depicted in an assembled configuration, with multiple branches and light strings removed for illustrative purposes.

As depicted, first lighted tree portion 104 includes first trunk portion 120, multiple branches 122, and one or more first light strings 124.

First trunk portion 120 as depicted comprises a generally cylindrical, hollow structure including trunk body 121 having a first end 123, second end 125, outside wall 126, and one or more branch-support rings 127. First trunk portion 120, in an embodiment, also defines multiple openings 166 in wall 126.

Branch-support rings 127 include multiple branch receivers 128 extending outwardly and away from trunk portion 120. In some embodiments, branch receivers 128 define a channel for receiving a trunk end of a branch 122.

Each branch 122 generally includes primary branch extension 130 and may also include multiple secondary branch extensions 132 extending away from branch extension 130. Branch 122 is connected to trunk portion 120 at a branch receiver 128 at trunk-end 134. In some embodiments, as depicted, branches 122 include strands 136 simulating the needles found on natural pine or coniferous trees. Strands 136 are attached to branch frame 135, which in some embodiments comprises a solid-core frame, such as a metal rod, wire, multiple twisted wires or rods, or similar such materials. In other embodiments, frame 135 may be hollow.

Trunk ends of branches 122 may be bent or otherwise formed to define a loop or circular opening such that trunk end 134 of branch 122 may be secured to branch receiver 128 by way of a pin (not depicted) extending through branch receiver 128 and the loop formed at trunk end 134 of branch 122. In this way, a branch 122 may be allowed to pivot about the pin and branch receiver 128, allowing tree portion 104 to collapse to a smaller envelope size for convenient storage. Other embodiments may employ other means to attached branches to trunk sections.

First light string 124 includes light string wiring 140 and a plurality of lighting element assemblies 142. Each lighting assembly element 142 includes housing 144 and lighting element 146. Lighting elements 146 may comprise incandescent bulbs, light-emitting diodes (LEDs), a combination thereof, or any of other known types of light-emitting elements.

As also described below with respect to FIG. 3, lighting elements 146 may be electrically connected in parallel, series, or a combination of series and parallel, to form a parallel-connected, series-connected, parallel-series connected, or series-parallel connected first light string 124.

In an embodiment, first light string 124 is affixed to one or more branches 122 of lighted tree portion 104 via multiple clips 150. A proximal end 152 of light string 124 may be connected to outside wall 126 of first trunk portion 120 by a connector or clip as described further below, or may be inserted through an opening 166 in wall 126 into an interior space defined by first trunk portion 120 and trunk body 121.

In one embodiment, first lighted tree portion 104 includes a plurality of first light strings 124. Such first light strings 124 may be substantially the same, for example, a series-parallel connected light string having 100 lighting element assemblies 142. In other embodiments, first lighted tree portion 104 may include first light strings 124 having a particular configuration and other first light strings 124 having another, different configuration. For example, first light strings 124 located closer to base portion 102 may be longer in length with more light emitting assemblies 142, while first light strings 124 further from base portion 102 may be relatively shorter in length, with fewer light emitting assemblies 142. In other embodiments, first lighted tree portion 104 may include only a single light string 124.

Second lighted tree portion 106, adjacent first lighted tree portion 104, is similar to lighted tree portion 104 and includes second trunk portion 160, multiple branches 122 and one or more second light strings 162.

Second trunk portion 160 as depicted also comprises a generally cylindrical, hollow structure including trunk body 161 having a first end 163, a second end 165, outside wall 164, and one or more branch-support rings 127. First trunk portion 120 also defines multiple openings 166 in wall 164.

In one embodiment, trunk portion 160 may have a trunk diameter that is substantially equal to a trunk diameter of first trunk portion 120, while in other embodiments, may have a trunk diameter that is different from that of the first trunk portion. In one such embodiment, a trunk diameter of second trunk portion 160 is slightly less than a trunk diameter of first trunk portion 120 at an end such that that trunk 116 has a somewhat tapered look.

Similar to first light strings 124, second light strings 162 may comprise any combination of series-connected, series-parallel, parallel-series, or parallel-connected individual or groupings of lighting element assemblies 142.

Third lighted tree portion 108, adjacent to second lighted tree portion 106 includes third trunk portion 180, branches 122, and one or more third light strings 182. In some embodiments, such as the depicted embodiment, a diameter of third trunk portion 180 may be somewhat smaller in diameter than a diameter of second lighted tree portion 108. As depicted, third trunk portion 180 comprises a relatively smaller diameter pipe-like body portion 184 including lower end 185, upper end 186, trunk wall 187, and defining top opening 188 (see also FIGS. 3 and 4). Also as depicted, in some embodiments, third trunk portion 180 may also not include branch-support rings 127, as branches 122 of third lighted tree portion 108 may be somewhat shorter in length than branches 122 of second lighted tree sections 106 and may be directly connected to body portion 184 of third trunk portion 180.

Third light string 182 includes wiring 190 and multiple lighting element assemblies 142. Similar to first light strings 124, third light strings 182 may comprise any combination of series-connected or parallel-connected individual or groups of lighting element assemblies 142.

In the embodiment depicted, third light string 182 emerges from top opening 188 such that a portion of third light string 182 is within an interior space defined by third trunk portion 180. Alternatively, third light string 182 may be connected via an electrical connector at opening 188. In other embodiments, third light string is mechanically connected to trunk portion via a connector at wall 186 of third trunk portion 180, or may be received in part by an opening (not depicted) in wall 186. In yet other embodiments, third light string 182 may be an extension of second light string 162.

Figure 3:
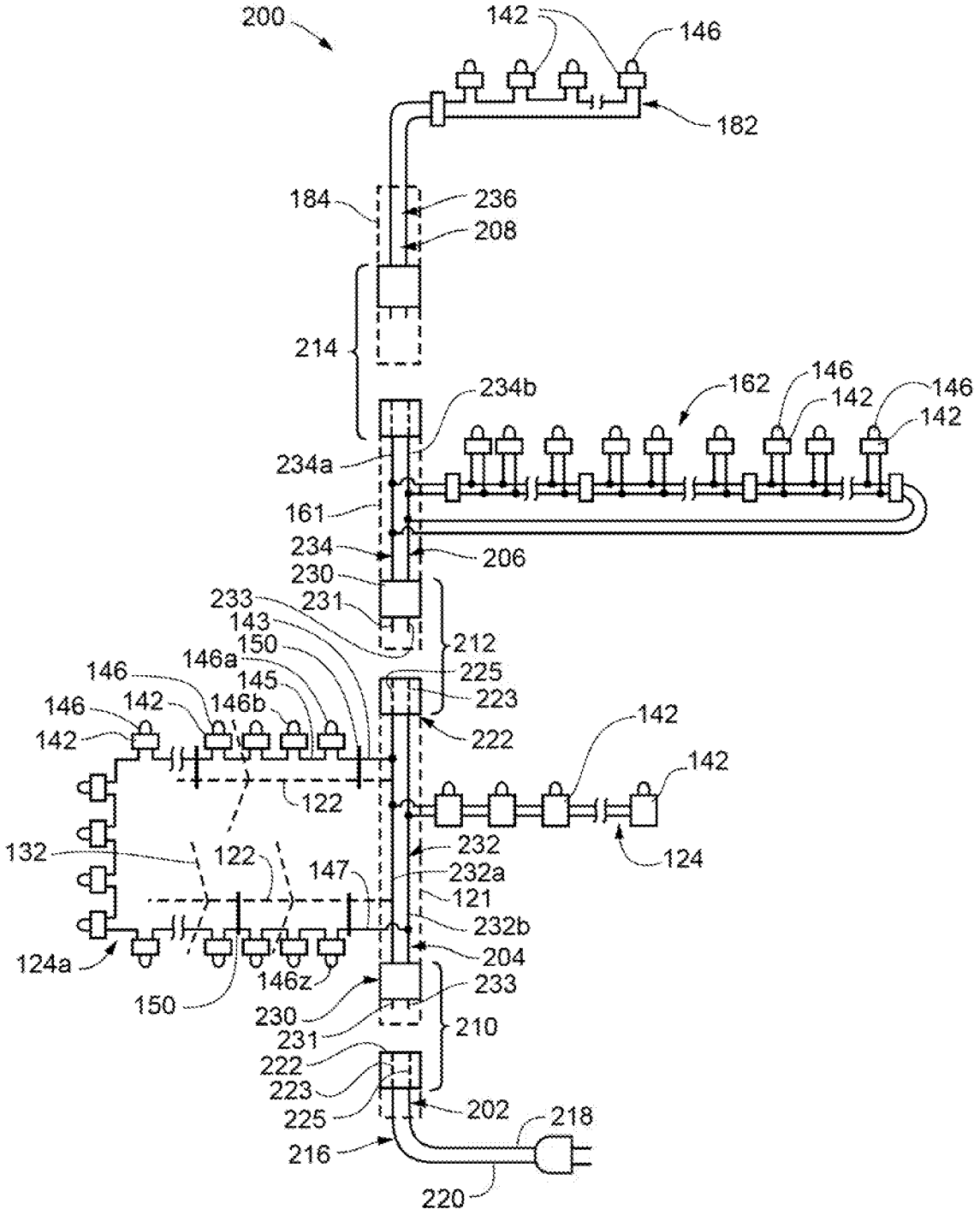
FIG. 3 is a block diagram of an electrical connection and wiring assembly of the modular, lighted artificial tree of FIG. 1.

Referring to FIG. 3, an embodiment of electrical connection and wiring harness assembly 200 is depicted. In an embodiment, electrical connection and wiring harness assembly 200 includes base portion electrical connection and wiring harness subassembly 202, first tree portion electrical connection and wiring harness subassembly 204, second tree portion electrical connection and wiring harness subassembly 206, and third electrical connection and wiring harness 208. Electrical connection and wiring harness assembly 200 also includes first electrical connector system 210, second electrical connector system 212 and third electrical connector system 214, electrically connecting base 102 to first tree portion 104, first tree portion 104 to second tree portion 106, and second tree portion 106 to third three portion 108.

In an embodiment, base electrical connection and wiring harness subassembly 202 includes power cord 216, first polarity wiring 218 having one or multiple wires, second polarity wiring 220, also having one or multiple wires, electrical connector 222, which in an embodiment comprises a female connector. Electrical connector 222 includes two or more electrical terminals 223 and 225 electrically connected to wires 220 and 218, respectively.

In an alternate embodiment, power cord 216 connects to wiring harness subassembly 204 and/or electrical connector 230 directly in a simplified electrical system.

In an embodiment, all or portions of base wiring harness 202 are positioned within trunk body 121.

First tree portion electrical connection and wiring harness subassembly 204 includes electrical connector 230, wire set 232 having first polarity wire 232*a* and second polarity wire 232*b*, and electrical connector 222. In an embodiment, electrical connector 222 is substantially the same as connector 222 of base portion connector 222. Electrical connector 222 includes two or more terminals 223 and 225 electrically connected to wires 232*a* and 232 *b*, respectively. In another embodiment, the connectors differ. Electrical connector 230 in the embodiment is a male electrical connector. Electrical connector 230 includes two or more terminals 231 and 233 electrically connected to wires 232*a* and 232*b*, respectively.

Second tree portion electrical connection and wiring harness subassembly 206 includes male electrical connector 230, wire set 234 having first polarity wire 234*a* and second polarity wire 234*b*, and female electrical connector 222. In an embodiment, electrical connector 222 is substantially the same as connector 222 of base portion connector 222, with terminals 223 and 225 electrically connected to wires 234*a* and 234*b*, respectively. In another embodiment, the connectors differ. Male electrical connector 230 includes electrical terminals 231 and 233 electrically connected to wires 234*a* and 234*b*, respectively.

Third tree portion electrical connection and wiring harness subassembly 208 includes electrical connector 230 and wire set 236.

It will be understood that for each male/female connecting pair 222/230 the position of each connector could be reversed such that, for example, subassembly 202 includes male connector 230 rather than female connector 222, and the male and female connectors on subassembly 204 are reversed from top to bottom.

Further embodiments of wiring harnesses, wire subassemblies, and electrical connectors are described in pending U.S. patent application Ser. No. 13/112,650, published as US 2012/0076957, and Ser. No. 13/240,668, published as US 2012/0075863, both entitled MODULAR LIGHTED TREE, and both of which are incorporated by reference herein in their entireties.

When assembled, base portion electrical connection and wiring harness subassembly 202 plugs into first tree portion electrical connection and wiring harness subassembly 204, which plugs into second tree portion electrical connection and wiring harness subassembly 206, and which plugs into third electrical connection and wiring harness 208 to form tree electrical connection and wiring harness assembly 200.

When assembled, an electrical connection is formed between subassemblies 202, 204, 206, and 208 such that power may be transmitted from an external source via power cord 216 to the various wire sets 232, 234, and 236, and distributed to multiple light sets 124, 162, and 182 of tree 100.

Still referring to FIG. 3, and with respect to the various light strings of tree 100, as described briefly above, a number of electrical configurations, using a variety of physical wiring harnesses, are possible. It will be understood that although parallel, series, and parallel-series light strings are depicted on a single tree 100 in FIGS. 1-3, in embodiments, tree 100 may only include light strings of one electrical configuration type, e.g., all light strings have series connected lighting elements, or all light strings have parallel, or all have parallel-series/series-parallel.

As depicted, first light string 124 is a "parallel" configured light string, such that all lighting elements 146 of lighting assemblies 142 are electrically connected in parallel.

In another embodiment, tree 100 includes light string 124*a* which as depicted includes series-connected lighting elements 146, though in other embodiments, light string 124*a* may be a series-parallel configuration. Each light string 124, 162, or 182 is electrically connected to a wiring harness of a tree portion. Electrical connection may be made within a trunk body, or outside a trunk body. In an embodiment, wiring of a light string may directly connected to a main wire using an electrical connector, to make a wire joint. In other embodiments, wires of light strings are integrated with the wiring harnesses, as described further below, such that wire joints are avoided.

Light string 124*a* as depicted is a "single-wire" light string (referred to as "single wire" as in many embodiments, only one wire having an insulator and a conductor, electrically connect any two lamp holders of a lighting element 142, as will be described further below. A first wire 143 electrically connects a first lighting element 146*a* to a first bus wire of wiring 234, and a second wire 145 connects lighting element 146*a* to lighting element 146*b*. As such, a "single" wire electrically and mechanically joins the two lighting elements 146*a* and 146*b*. A last single wire 147 connects last lighting element 146*z* to a second bus wire of wiring 234 to complete an electrical series circuit. This configuration allows first wire 143 to be connected to wiring 234 and tree portion 104 at a location different from the location that last wire 147 connects to wiring 234 and to tree portion 104, if desired.

One advantage of such an embodiment, is that light string 124*a* may be distributed amongst multiple branches 130, including branches that may be at different heights along tree portion 104, branches adjacent one another at the same height, branches opposite one another, and so on, without having to bring last wire 147 back to a point close to, or adjacent to, first wire 143. In an alternate embodiment not depicted, light string 124*a* spans more than one tree portion, with an electrical connector joining a first portion of the light string 124*a* (associated with first tree portion 104) and a second portion of the light string 124*a* (associated with second tree portion 106).

Figure 4:
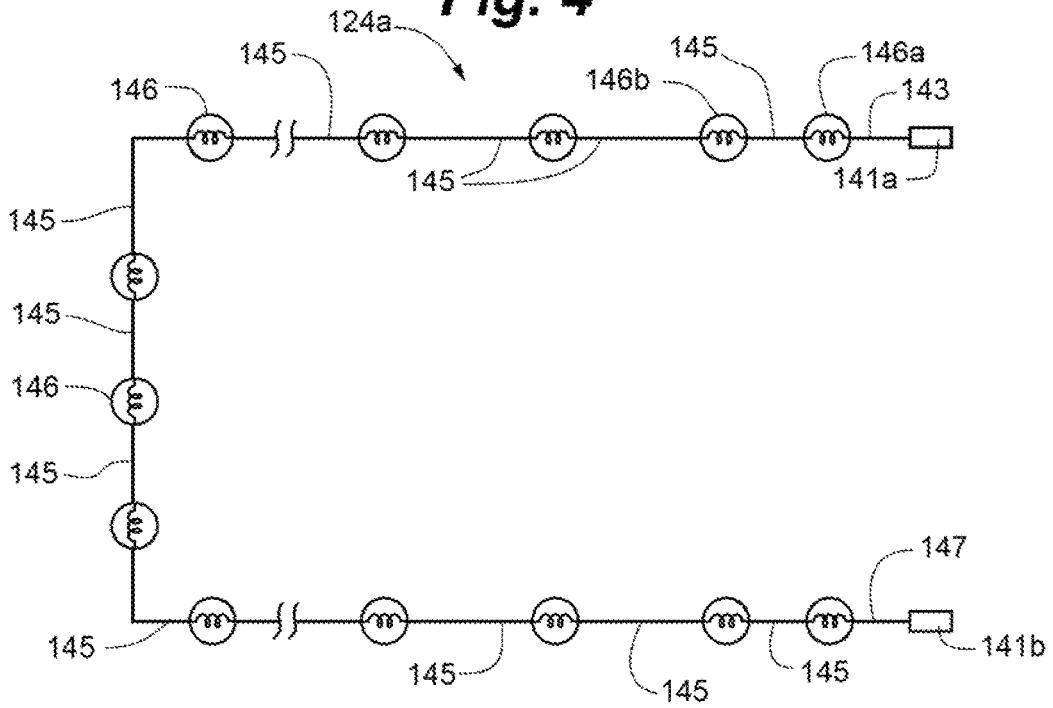
FIG. 4 depicts a wiring layout of a "single-wire" light string, according to an embodiment of the present invention.
Figure 5:
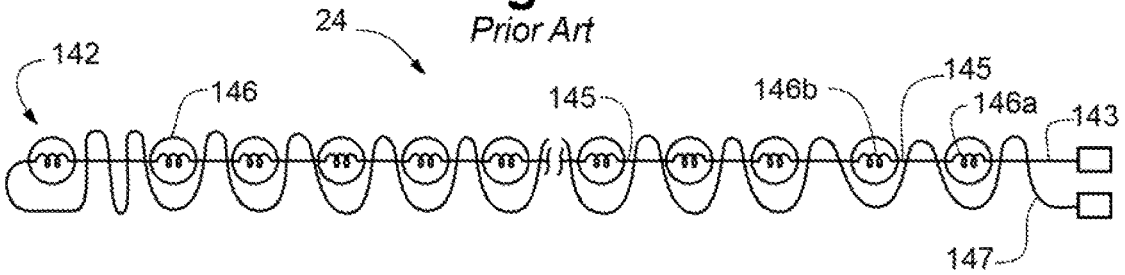
Fig. 5 Prior Art
FIG. 5 depicts a wiring layout of a "twisted-pair" light string of the prior art.

Referring to FIGS. 4 and 5, an embodiment of a single-wire construction light string 124 is depicted in FIG. 4, and a traditional twisted pair wire configuration is depicted in FIG. 5.

Referring specifically to FIG. 4, light string 124*a* includes a first lead wire 143 and a last return wire 147. In an embodiment, none of the single wires, including first wire 143, intermediate wires 145, and last wire 147 are intertwined, or twisted together. In the embodiment depicted, first wire 143 may be located at a first location of tree 100, while last wire 147 may be located at a different location of tree 100. In an embodiment, first wire 143 and last wire 147 are adjacent one another at the trunk. In an embodiment, lead wire 143 may be twisted with return wire 147, but a lead or return wire is not intertwined with other intermediate wires 145.

In another embodiment, a twine, false wire, or other string-like portion may be intertwined with first, intermediate, and last wires to provide pull strength to light string 124*a*. In another embodiment, such as the one described with respect to FIG. 4, no such additional string-like portion is added to single-wire light string 124*a*.

Conversely, and referring to FIG. 5, a prior art light string 24 includes a last wire 147, often referred to as an electrical "return wire", that is intertwined with the other single wires of light string 24, including first wire 143 and intermediate wires 145. The twisting of the return wire between lighting elements 146 and intermediate wires 145 strengthens the mechanical coupling of lighting element assemblies 142. If a pulling force is applied to wires between lighting element assemblies 142 (and lighting elements 146), it is less likely that wires will be pulled out of, or disengage from, lamp holders of lighting element assemblies 142 when the twisted-pair construction is used.

Referring generally to FIGS. 6-36, various embodiments of electrical connectors for use with lighted modular tree 100 of the present invention are depicted. In some embodiments, electrical connector pairs 222 and 333 are configured for use with two-bus, or two main wire wiring harnesses (such as wiring harness subassemblies 232 having a first polarity bus/main wire 232*a* and a second polarity bus/main wire 232*b*), and in other embodiments, are configured for use with wiring harnesses that include more than two bus wires (see also FIG. 37). In embodiments, each electrical connector 222 may be connected to its corresponding electrical connector 230 independent of a rotational alignment of the two electrical connectors, and/or independent of a rotational alignment between two trunk bodies, to make an electrical connection between electrical connectors such that a user does not need to be concerned with rotational alignment about an Axis A of individual tree portions when assembling tree 100.

For each electrical connector pair described below, reference numeral 222 will generally be used to refer to a first electrical connector as generically described and depicted in FIG. 3, and which in some embodiments generally comprises a female electrical connector, and reference numeral 230 will generally be used to refer to a second electrical connector, which in some embodiments generally comprises a male electrical connector.

Referring specifically to FIGS. 6 to 12, an embodiment of an electrical connection system, system 300, is depicted. Electrical connection system 300 is configured to be utilized with either direct current (DC) power or alternating (AC) power. However, electrical connection system 300 is particularly suited for safely providing AC power to tree 100. Further, in the depicted embodiment, female electrical connector 222 and male electrical connector 230 may be connected in any of a plurality of rotational configurations, ensuring a high-quality electrical connection not prone to arcing that is easy to connect by a user.

Figure 6:
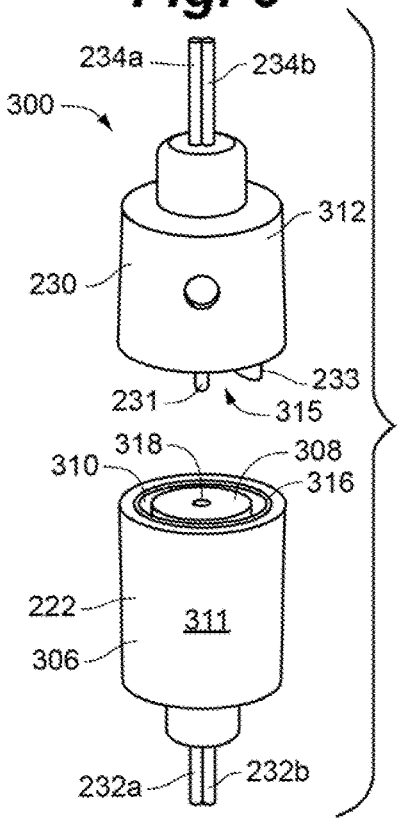
FIGS. 6-12 depict an embodiment of an electrical connector system having a central electrical terminal, according to an embodiment of the claimed invention.
Figure 7:
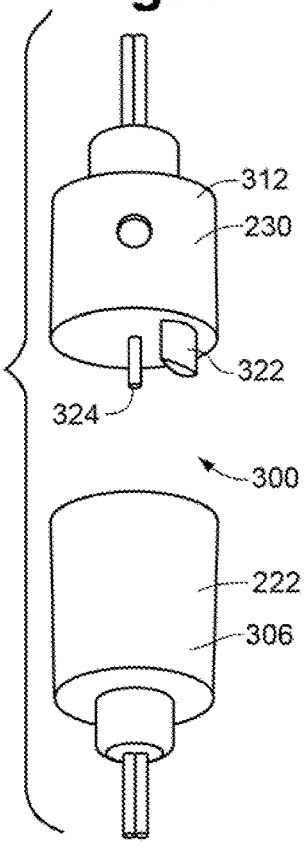

Referring to FIGS. 6 and 7, electrical connection system 300 is depicted. System 300 includes female or first electrical connector 222 and male or second electrical connector 230.

Figure 12:
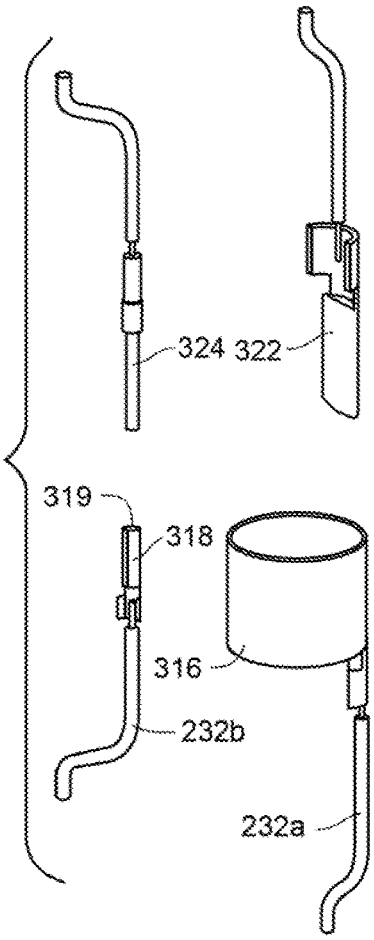
Figure 9:
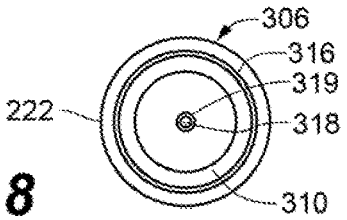
Figure 8:
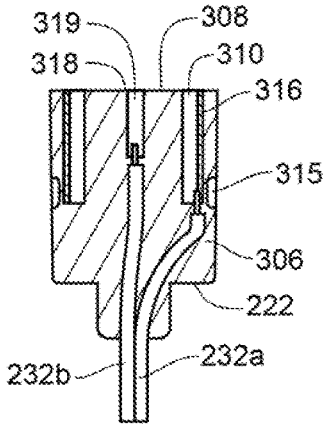
Figure 10:
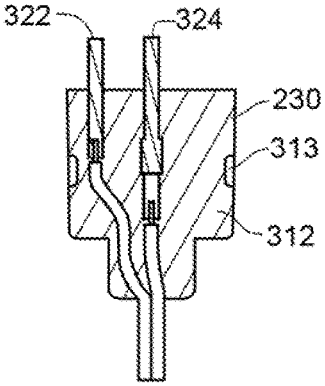

Referring also to FIGS. 8, 9, and 12, electrical connector 222 includes body 306, center projection 308, and defines annular cavity 310, and outside surface 311. Electrical connector 222 also includes first electrical contact or terminal 316 and 318.

In an embodiment, body 306 comprises a non-conducting material and comprises a generally cylindrical shape, having a circular cross section, so as to fit into a trunk body, such as trunk body 121. In other embodiments, body 306 comprises other shapes adapted to fit into trunk bodies having non-circular openings. In an embodiment, body 306 defines recess 315 at an exterior. Recess 315 may be used to locate and secure body 316 in a trunk body that includes a corresponding projection or detent inside the trunk body and configured to fit into recess 315. In another embodiment, recess 315 is used merely to initially locate body 315 through an opening in a trunk body.

In an embodiment, first electrical terminal 316 (analogous to terminal 225 of FIG. 3) comprises a ring which may be cylindrical as depicted, or a band, comprising a conductive material. In an alternate embodiment, terminal 316 comprises a flat ring defining a flat planar surface transverse to Axis A, rather than a cylindrical ring or band coaxial with Axis A. Electrical terminal 316 when assembled is electrically connected to a wire, such as wire 232*b*. Electrical terminal 316 is seated into cavity 310 of body 306, against an inside surface opposite projection 308. In an alternate embodiment, terminal 316 comprises a smaller diameter and is adjacent projection 308.

Second electrical terminal 318 (analogous to terminal 223 of FIG. 3) comprises a conductive material and defines receiving cavity 319. When assembled, second electrical terminal 318 is electrically connected to a wire or conductor, such as wire 232*a*, and is insertable into a second cavity of body 306.

When assembled into body 306, in an embodiment, electrical terminal 318 is generally located central to contact 316, such that the two contacts are concentric, coaxial, or share a common central axis, which in an embodiment, is also Axis A of tree 100 (see FIG. 1).

Referring to FIGS. 6, 7, and 10-12, electrical connector 230 includes body 312, electrical terminal 322 and electrical terminal 324. Body 312, in an embodiment, comprises a non-conductive material and also comprises a generally cylindrical shape with circular cross-section and to fit into a trunk body having a similarly shaped end opening. In an embodiment, body 312 defines recess 315 at an exterior. Recess 315 may be used to locate and electrical terminal 316 in a trunk body that includes a corresponding projection or detent inside the trunk body and configured to fit into recess 315. In another embodiment, recess 315 is used merely to initially locate body 315 through an opening in a trunk body.

It will be understood that the term "terminal" refers generally to an electrical terminal, connector, or other such conductive element in electrical contact with a conductor of a wire, and does not necessarily require termination of a wire.

In an embodiment, first electrical terminal 322 may comprise a blade shape, with an arcuate side and a flat side. In other embodiments, contact 322 may comprise two arcuate sides. In an embodiment, second-polarity contact 324 comprises a pin-like structure.

As will be described further below, contact 324 is configured to fit into contact 318, and contact 320 is configured to fit into cavity 310, thereby contacting an inside surface of contact 316 with its arcuate side and/or an edge.

Because lighted artificial trees may include many, many light strings and light elements, the power required to light tree 100 may be significant. This may be especially true for trees such as tree 100 that may use incandescent bulbs, as opposed to LED bulbs as lighting elements. Further, the use of AC power combined with a high-current draw increases the potential for arcing between electrical contacts of a tree 100. Electrical connection system 300 enables safe electrical connections between modular tree sections by providing a significant distance between electrical contacts of a first polarity, such as electrical terminals 322 and 316, and electrical contacts of a second polarity, such as electrical terminals 318 and 324. Further, insulating projection 308 separates the terminals of differing polarity so as to further prevent electrical arcing.

Figure 13:
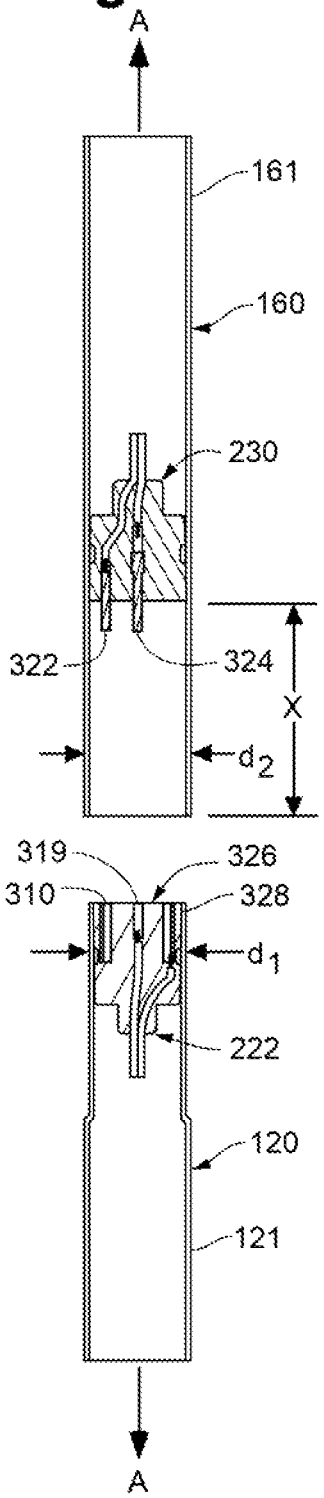
FIGS. 13-14 depict the electrical connector system of FIGS. 6-12 as positioned in a tree trunk, according to an embodiment of the claimed invention.

Referring to FIG. 13, electrical connector 222 is inserted into trunk body 121 having an end diameter $d_1$; male electrical connector 230 is inserted into trunk body 161 having an end diameter $d_2$. In an embodiment, electrical connector 230 is inserted a distance X into an end of trunk body 161. Conversely, in an embodiment, electrical connector 222 is inserted into an end of trunk body 121 such that a top surface 326 of body 306 is even with a distal most end or tip 328 of trunk body 121. As will be explained further, such a configuration allows both the coupling of the trunk bodies 121 and 161 and the coupling of the pair of electrical connectors 222 and 230.

Electrical connectors 222 and 230 are secured in their respective trunk bodies by any variety of means, including the use of fasteners that penetrate the trunk body and connector body, by mating recesses 313 and 315 to corresponding projections on an inside surface of the trunk bodies (e.g., snap fit), via a friction fit, through the use of an adhesive, or by other such means.

Figure 14:
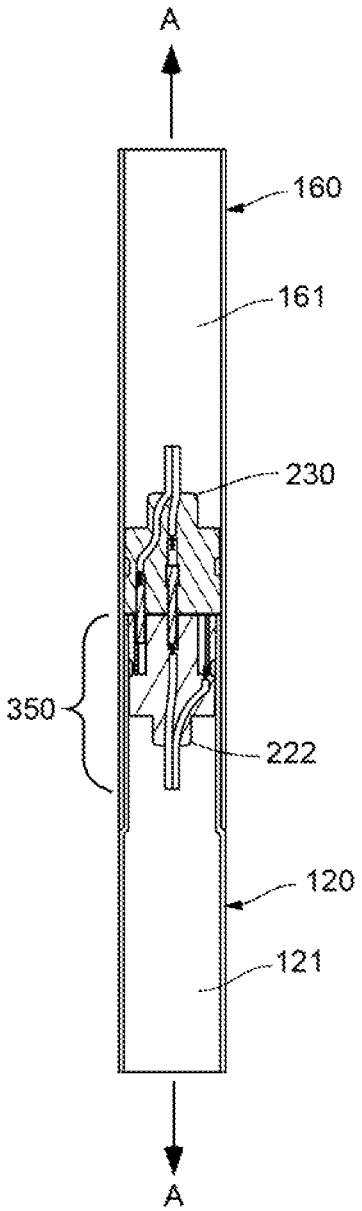
Figure 15:
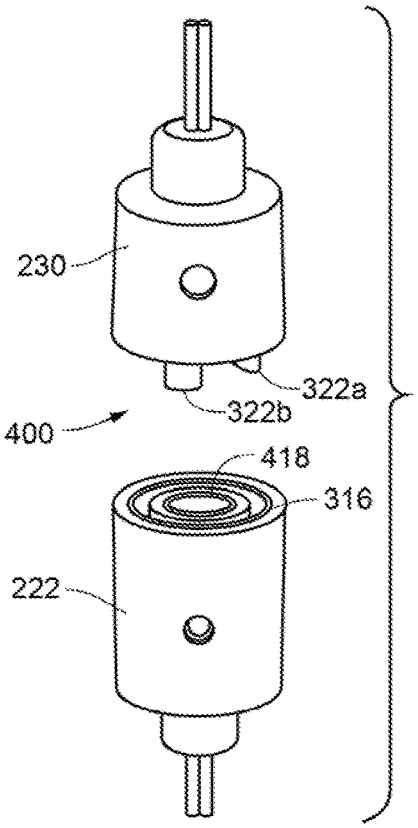
FIGS. 15-20 depict another embodiment of an electrical connector system, according to an embodiment of the claimed invention.
Figure 16:
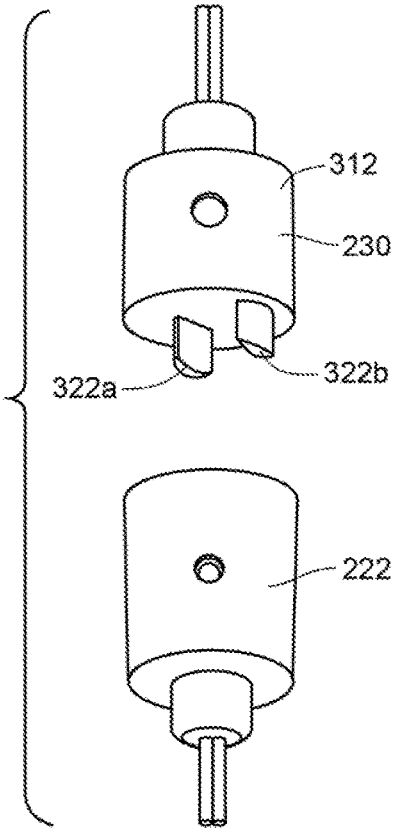
Figure 18:
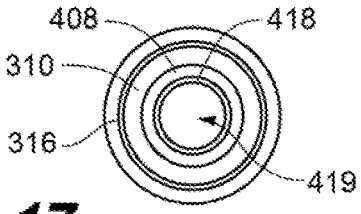
Figure 20:
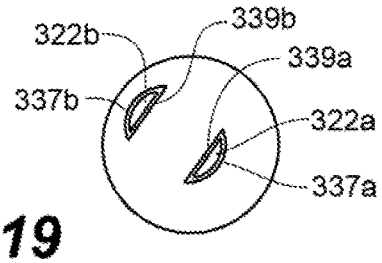
Figure 17:
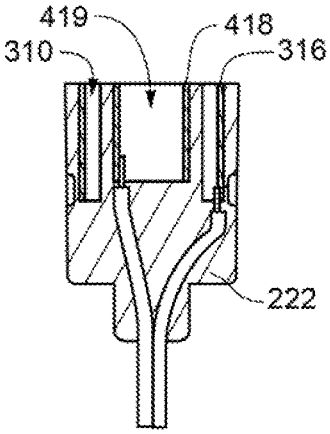
Figure 19:
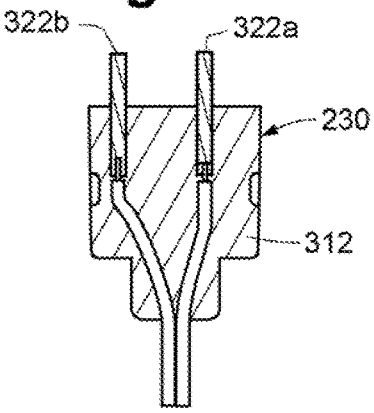

Referring to FIG. 14, trunk body 121 and trunk body 161 are aligned along Axis A. Trunk body 121 is then coupled to trunk body 161 via insertion of an end of trunk body 121 into an end of trunk body 161. This is possible since outside diameter d1 of trunk body 121 is the same as, or slightly less than, inside diameter d2 of trunk body 161. Correspondingly, a diameter of electrical connector 222 is slightly less than a diameter of electrical connector 230. In an embodiment, ends of trunk bodies 121 and 161 overlap in region 350.

This coupling causes electrical connector 222 to make electrical connection with electrical connector 230 such that electrical terminal 316 is in contact with terminal 322 and electrical terminal 318 is in electrical communication or contact with terminal 324.

Figure 11:
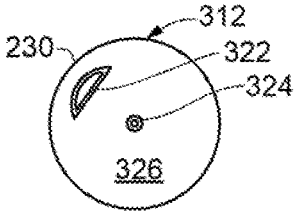

More specifically, and referring also to FIGS. 9 and 11, electrical terminal 322 is received by annular cavity 310, such that the arcuate side of terminal 322 makes electrical connection with an inside surface of band-like electrical terminal 316; pin-like terminal 324 is received by cavity 319, such that terminal 324 makes electrical connection with terminal 318.

A feature of the claimed invention described above is that trunk bodies 121 and 161 may be aligned along Axis A, but can be rotated about Axis A in any rotational alignment, or in some embodiments, any of a plurality of rotational alignments, and brought together causing electrical connection to be made between electrical connectors 222 and 230, and hence between tree portions 102 and 104. Because of the cylindrical shapes of receiving contacts 316 and 318, first trunk portion 120 may be aligned or rotated to any rotational position relative to trunk portion 160 about Axis A then the two trunk portions coupled together to make an electrical connection between tree sections.

Referring to FIGS. 15-19, an alternate embodiment of previously-described system 300, is depicted as system 400.

System 400 is similar to system 300, with some exceptions. Electrical connector 230 includes two blade-like electrical contacts 322, namely first electrical terminal 322*a* and second electrical terminal 322*b*. First electrical terminal 322*a* is located somewhat off-center of a top surface of body 312; second electrical terminal is 322*b* is located near a periphery of a top surface of body 312. Both terminals project outwardly and away from body 312. In an embodiment, terminal 322*a* includes arcuate side 337*a* and flat side 339*a*, while terminal 322*b* includes arcuate side 327*b* and flat side 339*b*. In the depicted embodiment, neither terminal 322*a* or 332*b* is central to body 312, and each terminal 322*a* and 322*b* are different distances from an outside edge of body 312.

Electrical connector 222 of system 400 is substantially the same as electrical connector 222 of system 300, with the exception that a center cavity 419 is larger than system center cavity 319, and electric terminal 418 is enlarged to form a band-like or ring-like electrical terminal. Electrical terminals 418 and 316 are concentric about a center axis of electrical connector 222 of system 400.

Figure 21:
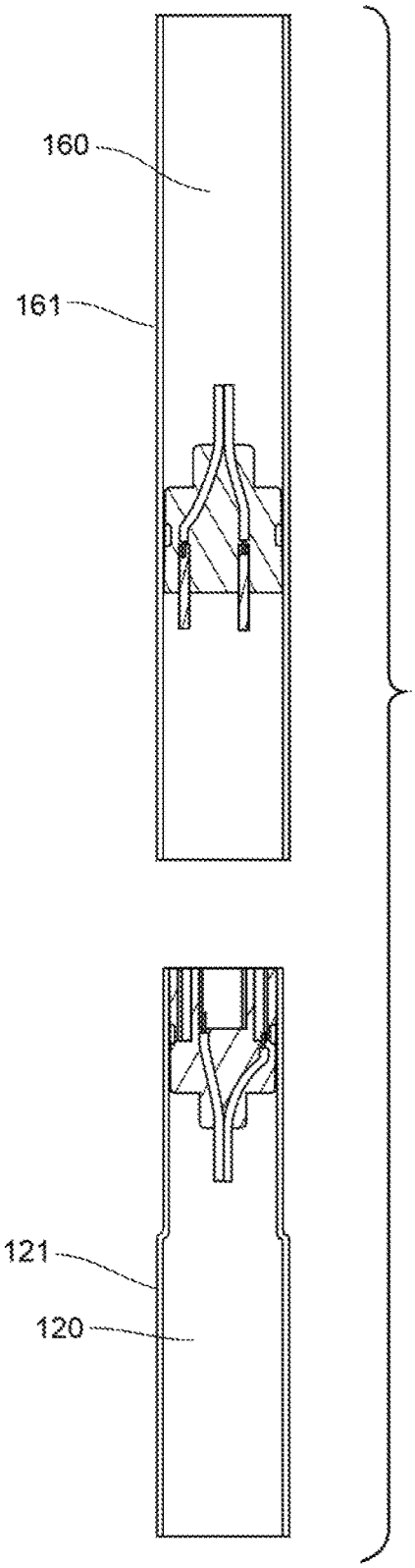
FIGS. 21-22 depict the electrical connector system of FIGS. 15-19 as positioned in a tree trunk, according to an embodiment of the claimed invention.

Referring to FIG. 21, in an embodiment, electrical connectors 222 and 230 of system 400 are seated in their respective trunk bodies 121 and 161 in a manner substantially the same as system 300.

Figure 22:
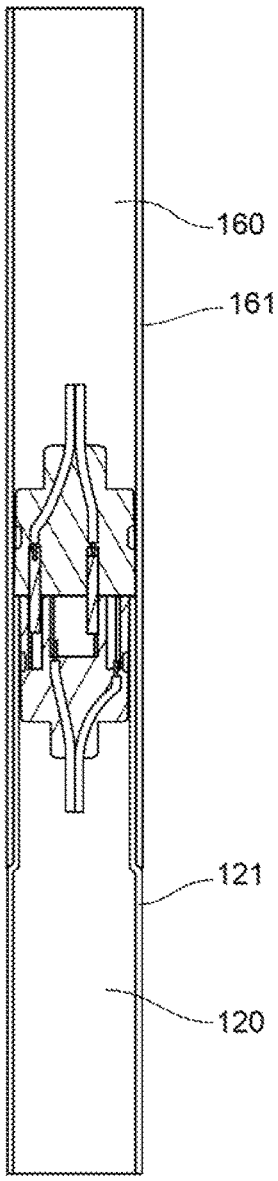
Figure 23:
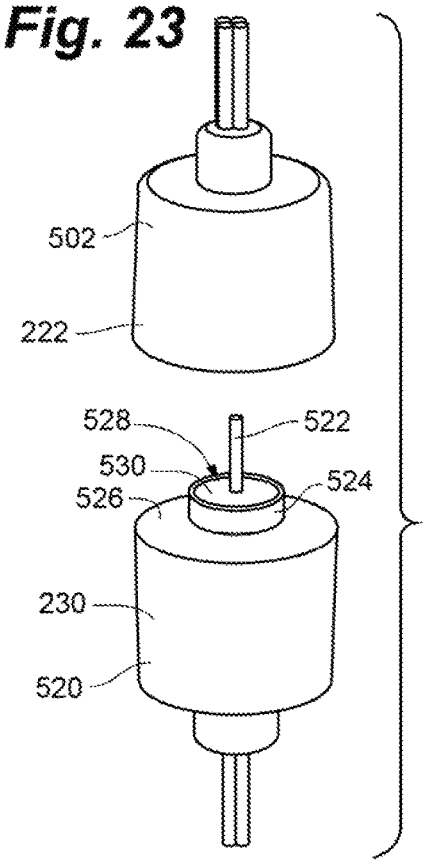
FIGS. 23-28 depict another electrical connector system, according to an embodiment of the claimed invention.
Figure 24:
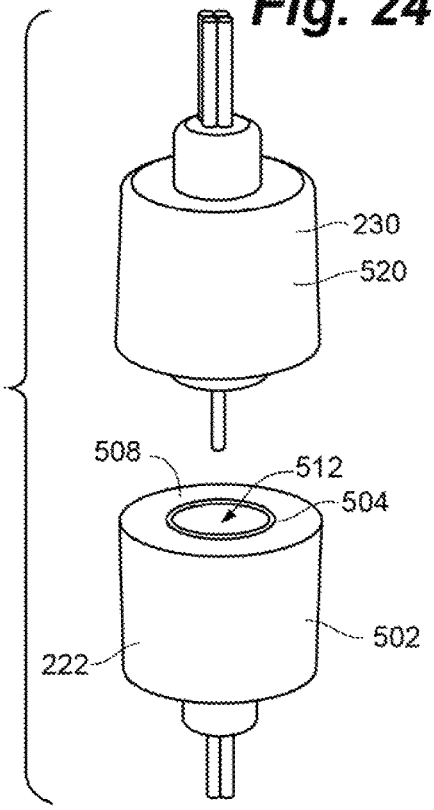
Figure 26:
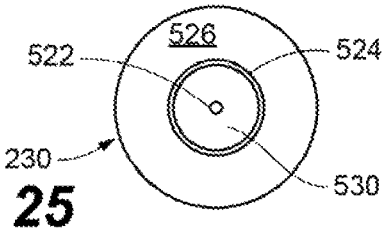
Figure 28:
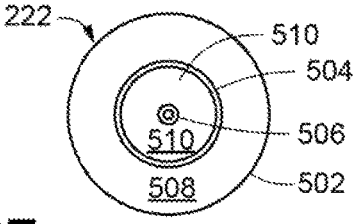
Figure 25:
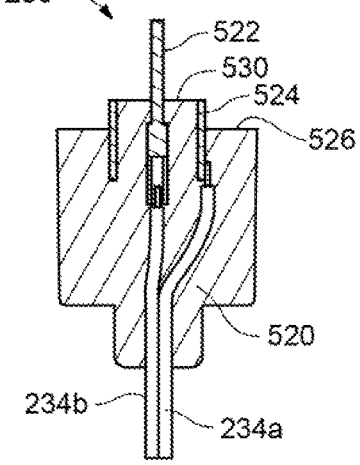
Figure 27:
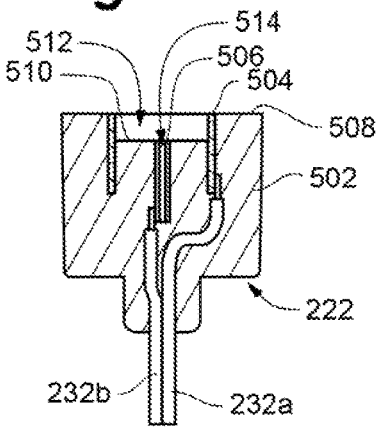
Figure 29:
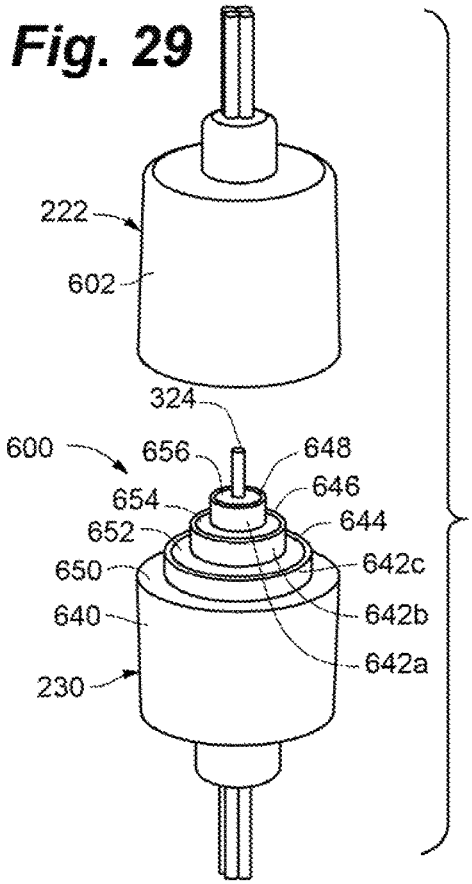
FIGS. 29-36 depict an electrical connector system that includes four electrical terminals per connector, according to an embodiment of the claimed invention.
Figure 30:
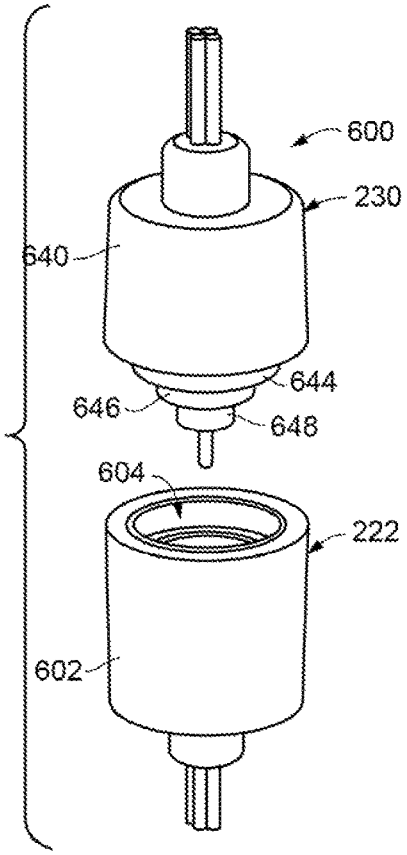
Figure 35:
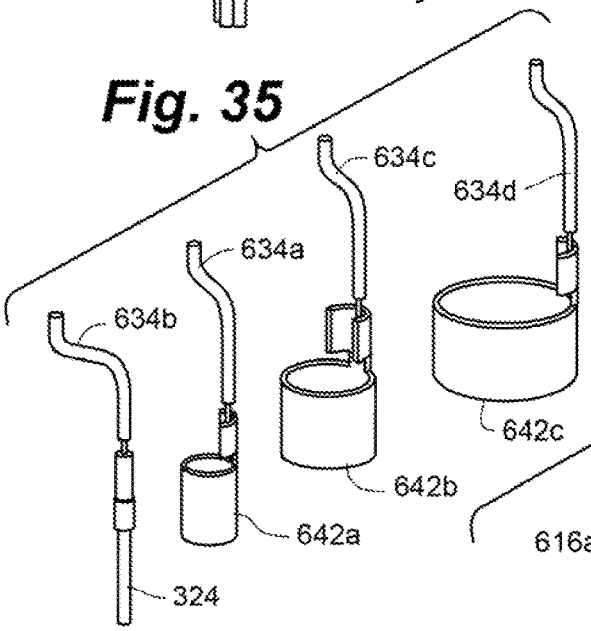
Figure 36:
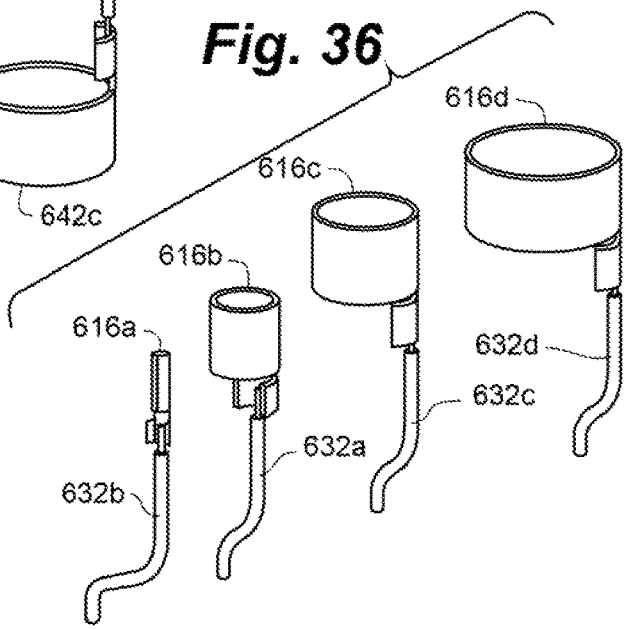
Figure 31:
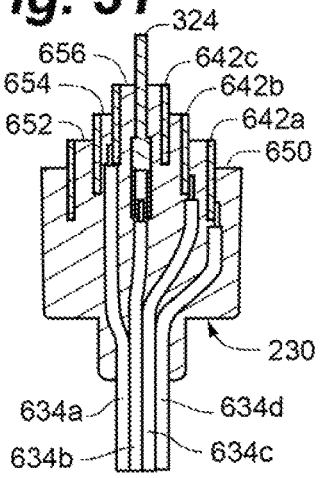
Figure 32:
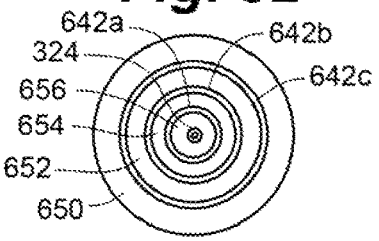
Figure 33:
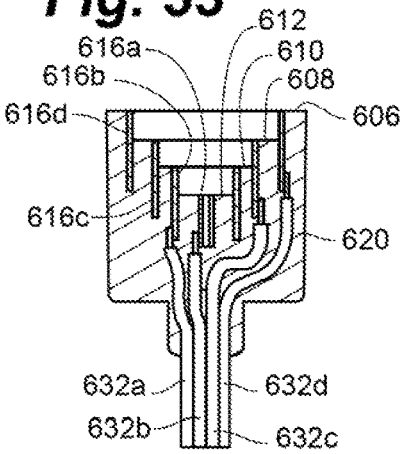
Figure 34:
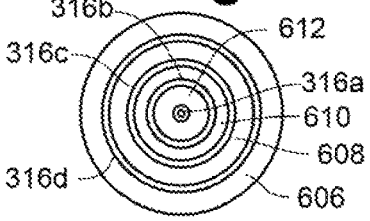

Referring to FIG. 22 and to FIGS. 17-20, when tree portions 120 and 160, as well as their trunk bodies 121 and 161 are coupled together, electrical connectors 222 and 230 make electrical connection.

More specifically, electrical terminal 322*a* fits into cavity 310 such that arcuate side 337*a* makes contact with terminal 316; electrical terminal 322*b* fits into cavity 419 such that arcuate side 337*b* makes electrical contact with terminal 418.

Similar to system 300, system 400 does not require any particular rotational alignment between electrical connectors, trunk bodies, or tree portions, to make electrical connection.

Referring to FIGS. 23-27, another embodiment of an electrical connector system of the claimed invention, system 500, is depicted. Connector system 500 includes pairs of electrical terminals that are concentric to one another, and coaxial about a central axis when electrically connected.

Electrical connector 222 of system 500, in this particular embodiment, comprises body 502, first electrical terminal 504, and second electrical terminal 506. Body 506 also defines a generally planar annular top surface 508 and a generally planar annual inner surface 510. Top surface 508 in an embodiment forms a parallel plane with inner surface 510.

Body 506 also defines cavity 512 having a cavity portion 514.

In an embodiment, electrical terminal 504 comprises a generally circular band 504 similar to other band-like terminals described above, including electrical terminal 316. Electrical terminal 504 is located at least in part in cavity 512, with an inside surface confronting a center of cavity 512.

In an embodiment, electrical terminal 506 forms a generally cylindrical shape adapted to receive a pin-like terminal of electrical connector 230, as described further below. In an embodiment, electrical terminal 506 is recessed into body 502 such that top end of terminal 506 is below a plane formed by top surface 508. Electrical terminal 506 as depicted is located along a central axis of body 506, and is generally coaxial with electrical contact 504.

Electrical connector 230 of system 500, in this particular embodiment, comprises body 520, first electrical terminal 522, and second electrical terminal 524. Body 520 also defines a generally-planar first annular surface 526, projection 528 with second generally-planar annular surface 530. Projection 528 projects outwardly and away from body 520 and surface 526 in a tiered, or step-like fashion. First surface 526 in an embodiment forms a plane generally below and parallel with second surface 530.

First electrical terminal 522 in an embodiment comprises a pin-like structure projecting outwardly and away from body 520 and along a central axis of connector 230.

Second electrical terminal 524 is an annular, band-like, or ring-like structure that is partially embedded in body 520, in an embodiment, and projects upwardly and away from surface 526, such that a portion of conductive terminal 524 is exposed.

When electrical connectors 222 and 230 are coupled together to form an electrical connection between their respective electrical terminals, projection 528 and a portion of electrical terminal is received by cavity 512, while electrical terminal 522 is received into cavity 514 formed within electrical terminal 506. When coupled thusly, electrical terminal 524 is in electrical connection with electrical terminal 504, and terminal 522 is in electrical connection with terminal 506. Consequently, wire or conductor 232*a* is electrically connected to wire 234*a* and wire 232*b* is electrically connected to wire 234*b*.

Advantages of system 500 include increased contact area between the two band-like electrical terminals 504 and 524 and a strengthened mechanical connection between connectors 222 and 230 due in part to the insertion of projection 528 into cavity 512.

The above-described embodiments of electrical connection systems 300-500 are depicted as being adapted for two main/bus-wire wiring harnesses and subassemblies as depicted in FIG. 3. However, it will be understood that the electrical connectors and systems of the claimed invention may be adapted to cooperate with wiring harnesses and subassemblies having more than two main wires. One such embodiment is described below with respect to FIGS. 29-36.

Referring to FIGS. 29-36, a tiered electrical connector system 600 is depicted. In an embodiment, and as depicted, system 600 is configured to connect to four-wire wiring harnesses and subassemblies, though it will be understood that system 600 could be configured to have additional electrical terminals to connect with wiring harnesses having more than four wires.

In an embodiment, system 600 includes tiered electrical connector 222 and tiered electrical connector 230.

Tiered electrical connector 222 comprises body 602 and cylindrical or band-like electrical terminal set 616, including terminals 616*a*, 616*b*, 616*c*, and 616*d*. Tiered electrical connector 222 also defines a tiered cavity 604.

Body 602 defines top, generally planar annular surface 606, and a plurality of tiered, generally planar and annular surfaces within tiered cavity 604. Tiered surfaces within cavity 604 include surface 608, 610, and 612. Surfaces 606, 608, 610, and 612 form decreasingly smaller annular rings as a center of connector 222 is approached. Further, planes formed by surfaces 606, 608, 610 and 612 are generally parallel.

Terminal set 616 comprises the set of concentrically arranged cylindrical electrical terminals 616*a*, 616*b*, 616*c*, and 616*d*, each having an increasingly larger diameter, and connected to wires 632*a*, 632*b*, 632*c*, and 632*d*, respectively. In an embodiment, central terminal 616*a* is a first polarity, e.g., neutral, and terminals 616*b, c*, and *d* comprise a second polarity, e.g., positive, "live" or "hot". In another embodiment, two terminals comprise a first polarity, and two terminals comprise a second polarity.

Tiered electrical connector 230 comprises body 640, electrical terminal 324, and cylindrical terminal set 642 comprising electrical terminals 642*a*, 642*b*, and 642*c*.

Tiered body 640 forms first tier 644, second tier 646 and third tier 648. Tiered body 640 and its respective tiers also define annular surfaces 650, 652, 654 and 656. In an embodiment, third tier 648 is furthest from surface 650; second their 646 is second furthest from surface 650; and first tier is closest to surface 650. In an embodiment, each tier has approximately the same tier height, defined as a vertical distance from a plane of one tier to a plane of an adjacent tier.

Terminal set 642 comprises the set of concentrically arranged cylindrical electrical terminals 642*a*, 642*b*, and 642*c* each having an increasingly larger diameter, and connected to wires 632*b*, 632*c*, and 632*d*, respectively. In an embodiment, central terminal 324 is a first polarity, e.g., neutral, and terminals 634*a, b*, and *c* comprise a second polarity, e.g., positive, "live" or "hot". In another embodiment, two terminals comprise a first polarity, and two terminals comprise a second polarity.

When electrical connector 222 of system 600 is coupled with electrical connector 230, tiered cavity 604 receives a portion of electrical connector 230, including tiers 644, 646, and 648 and portions of their respective electrical terminals 642*a*, 642*b*, and 642*c*. In an embodiment, surfaces 650, 652, 654, and 656 of electrical connector 230 are adjacent, and in some embodiments, in contact with, surfaces 606, 608, 610 and 612, respectively, of electrical connector 222. As such, a secure mechanical fit is formed between electrical connector 222 and electrical connector 230.

A safe electrical connection is also made between connectors 222 and 230. Terminal 316*a* receives terminal 324, making an electrical connection between the two terminals and between their respective wires 632*b* and 634*b*. In an alternate embodiment, terminals 316*a* and 324 may be exchanged for terminals similar to 418 and 322*a* of system 400.

Further, an outside surface of terminal 642*a* contacts in inside surface of terminal 316*b* to make an electrical connection between wires 632*a* and 634*a*; an outside surface of terminal 642*b* contacts in inside surface of terminal 616*c* to make an electrical connection between wires 632*c* and 634*c*; and an outside surface of terminal 642*c* contacts in inside surface of terminal 616*d* to make an electrical connection between wires 632*d* and 634*d*. In an embodiment, each of terminals 324, 642*a*, 642*b*, and 642*c* have outside diameters that are approximately the same size as their corresponding mating terminals 616*a*, 616*b*, 616*c*, and 616*d*, respectively such that each terminal pair makes surface contact as described above.

The connection of the terminal sets results in electrical connection between the respective wire sets 632 and 634, such that power may be provided from one tree portion to another.

Consequently, not only does the coupling of tiered electrical connectors 222 and 230 result in a superior mechanical connection, electrical connections between multiple pairs of electrical terminals within a relatively small space is made with minimal risk of arcing between terminals of disparate polarity.

Figure 37:
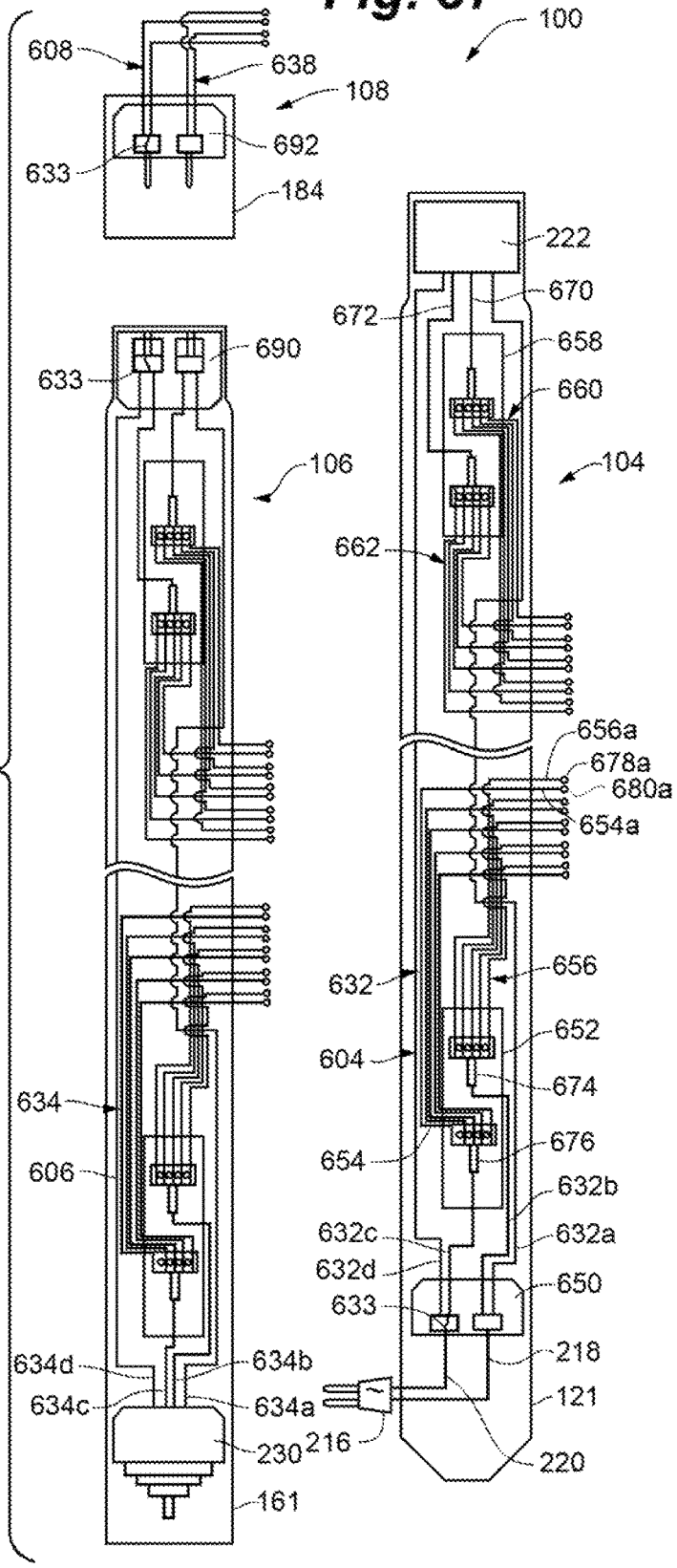
FIG. 37 depicts an electrical schematic of an electrical wiring harness and connection system positioned in portions of the tree of FIG. 1, according to an embodiment of the claimed invention.

Referring to FIG. 37, an embodiment of tiered electrical connectors 222 and 230 are implemented in tree 100. Tree portions 104, 106, and 108 are depicted less branches, branch rings and light strings for the sake of more clearly illustrating the advantageous electrical connection system of tree 100.

In this embodiment, tree portion 104 includes trunk body 121, power cord 216, and wiring harness subassembly 604. Tree portion 106 includes trunk body 161 and wiring harness subassembly 606; tree portion 108 includes trunk portion 184 and wiring harness subassembly 608 with wire set 638.

In the embodiment depicted, wiring harness subassemblies 604, 606, and 608 comprise 4-wire wiring harness subassemblies with two electrical polarities, though it will be understood that in other embodiments, wiring harness subassemblies 604, 606, and 608 could comprise harnesses that are based on more than 4-wires and two electrical polarities.

Wiring harness subassembly 604 includes electrical connector 650, primary wire set 632 comprising main/bus wires 632*a*, 632*b*, 632*c*, and 632*d*, first hub 652, light string wire set 654, light string wire set 656, second hub 658, light string wire set 660, light string wire set 662, and tiered electrical connector 222.

In this embodiment, electrical connector 650 receives first polarity power wire 218, electrically connecting it to bus wires 632*a* and 632*b*, and receives second polarity power wire 220, electrically connecting it to bus wires 632*c* and 632*d*. In an embodiment, power cord 216 is adapted to plug into an AC power supply, and may include a fuse. Electrical connector 650 may also include an in-line power fuse 633, as depicted. It will be understood that electrical connectors 222 and 230 may also include in-line fuses 733 inside their respective bodies to provide protection to tree 100 in the event of a power surge, short or other such situation.

In an embodiment, electrical connector 650 may include a transformer for converting AC power to DC power.

In an embodiment, bus wire 632*a* and 632*d* extend from electrical connector 650 through trunk body 121 to tiered electrical connector 222, thusly providing power to electrical connector 222. At or near electrical connector 222, bus wire 632*a* electrically connects to conductor 670 and bus wire 632*d* electrically connects to conductor 672, thusly providing power to hub 658.

In an embodiment, bus wires 632*b* and 632*c* are electrically connected to hub 652, thereby providing power to hub 652.

In an embodiment, hub 652 includes terminal block 674 and 676 electrically connected to bus wires 632*b* and 632*c*. Terminal blocks 674 and 676 are electrically connected to wire sets 656 and 654, respectively. As such, each wire of wire set 656, including wire 656*a*, is electrically connected to first polarity power wire 218, and each wire of wire set 654, including wire 654*a* is electrically connected to second polarity power wire 220. In the embodiment depicted, terminal blocks 674 and 676 each distribute power to five individual wires, in an embodiment, such that five light strings may be powered by hub 652. In an alternate embodiment, hub 652 may provide power to more or fewer light strings 124, depending on the number of light strings desired on tree 100.

In an embodiment, each wire of wire set 656 terminates at a light string wire connector 678, for example, wire 656*a* terminates at light string wire connector 678*a*; and each wire of wire set 654 terminates at a light string wire connector 680, for example, wire 654*a* terminates at light string wire connector 680*a*. Light strings 124 (see also FIGS. 4 and 38), including light strings 124*a*, are electrically connected to light string wire connectors 678 and 680, thusly receiving power when power cord 216 receives power from an external power source.

In alternate embodiments, wires 654 and 656 may not include light string wire connectors 678 and 680, but rather, may be integrated with their corresponding light strings, forming the first and last wires, respectively, of their corresponding light string.

Hub 652 in an embodiment comprises a printed circuit board enclosed in a housing (not depicted). In an embodiment, the hub housing is conformal to trunk 121, which in an embodiment means that the hub housing is generally cylindrical.

Hub 658 is substantially the same as hub 652, receiving power from electrical connector 222 and/or conductors 670 and 672, and distributing power to wire sets 660 and 662 for powering light strings 124 (not shown).

Wiring harness 604 provides a number of advantages relating to wire management and organization. For example, as depicted, a first quantity of light strings 124 are powered by light string wires that are connected to first hub 652 and electrical connector 650, such that only those wire sets 654 and 656, extending upwardly from a bottom of trunk body 121, towards a center of trunk body 121, connect to, and power, the first quantity light strings 124 of tree portion 104. In an embodiment, the first quantity of light strings 124 is generally attached to a lower portion of tree portion 104.

Bus wires 632*a* and 632*d* extend upwardly from connector 650 to connector 222, then wire sets 660 and 662, used to power the remaining, second portion of light strings 124, extend axially downward towards a center of trunk body 121. The second quantity of light strings 124 are generally attached to tree portion 100 at an upper part of tree portion 104.

Such a wiring layout maximizes use of the space within trunk cavity 121 by evenly distributing the individual wires powering light strings 124. Alternatively, if all light strings 124 connected to a lower hub 652, a bulk of wiring would be located at a lower portion of trunk body 121, making it more difficult to fit the wiring within the trunk cavity, and creating more opportunities for arcing, shorting, and increased electromagnetic interference.

Wiring harness subassembly 606 of tree portion 106 with its tiered connector 230 distributes power to lights 162 (see FIG. 2), in a manner similar to wiring harness subassembly 604.

Wiring harness subassembly 608 of tree portion 108 may be a simplified wiring harness as depicted, due, in part, to the fewer number of light strings powered, and lesser size and weight.

Further, as described above, tree portion 106 couples with tree portion 104 independent of a rotational alignment of trunk bodies or tree portions, such that a user may easily assemble tree 100, without a need to rotationally align the connectors. In the embodiment depicted, tree portion 106 includes female electrical connector 690 that couples to male electrical connector 692 to electrically connect tree portions 106 and 108. In the depicted embodiment, connector 690 and 692 are two-pin connectors that require one of two rotational alignments of tree portions 106 and 108 in order to be coupled. Due to the smaller size and weight of tree portion 108, in some embodiments, such a two-pin or two-prong or keyed electrical connection system may not be burdensome for a user to accommodate and is presented to illustrate an alternate embodiment.

Although not depicted, it will be understood that one or more electrical controllers may be housed within trunk body 121 or 161. In an embodiment, such a controller would be electrically or communicatively coupled to hubs 652/658 and light strings 124/162 to control power to one or more light strings to create various visual effects including color changing, flashing, fading, and so on.

Wiring harness subassembly with hubs 652 and 658 provide a number of additional advantages. One such advantage is that the electrical connection of the many light strings of tree 100 to a power supply can be made at one, two, or only a few locations. Further, the use of a hub with terminal blocks for making the electrical connections ensures a uniform electrical connection, eliminating the need to crimp or solder individual light string wires to power wires.

Figure 38:
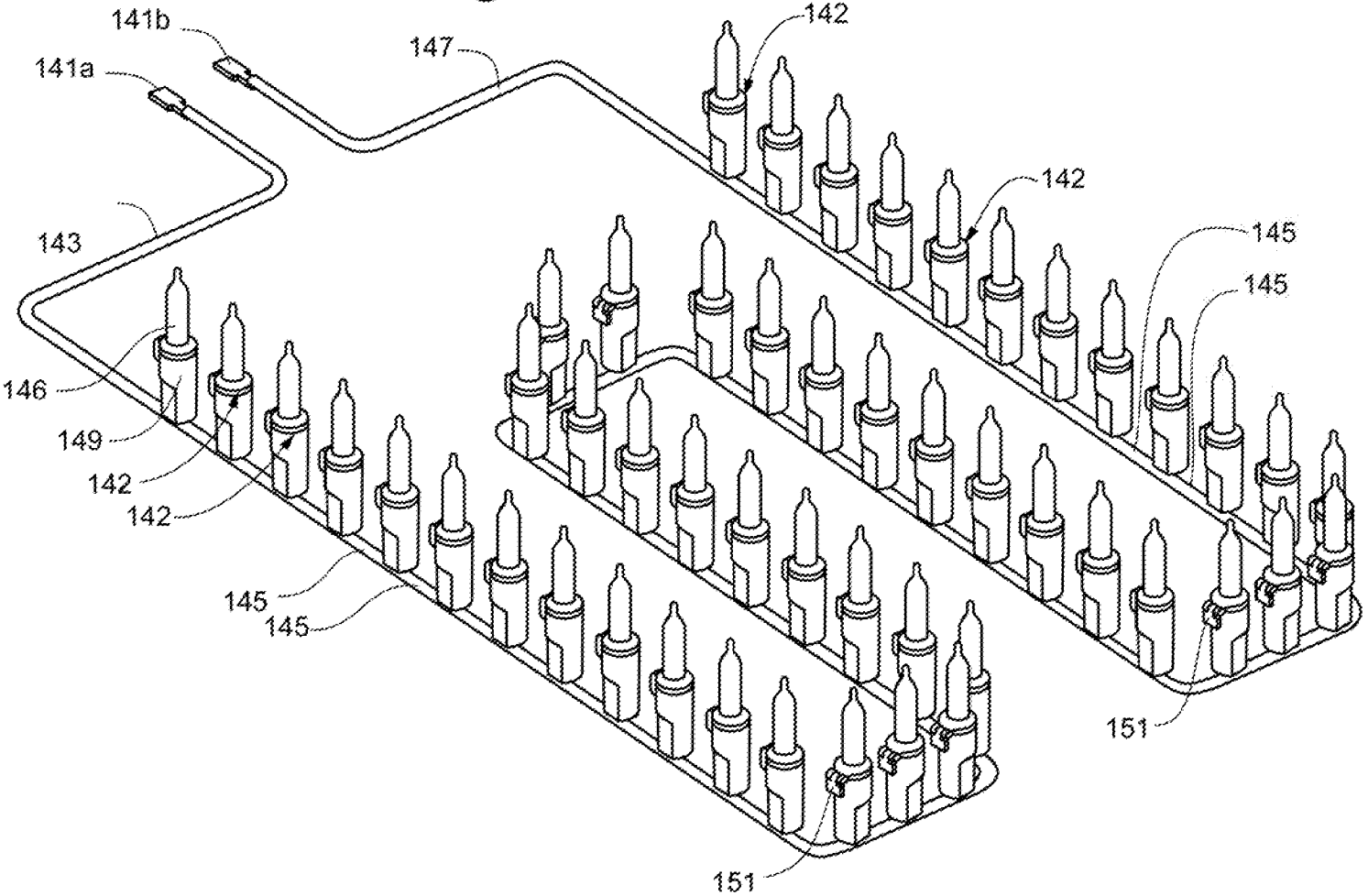
FIG. 38 depicts a light string of the tree of FIG. 1, according to an embodiment of the claimed invention.

Referring to FIG. 38, a "single-wire" light string 124*a* for use with an embodiment of tree 100, including the embodiment of tree 100 depicted and described with respect to FIG. 37, is depicted.

Light string 124*a* as depicted is substantially the same as light string 124*a* as depicted and described with respect to FIG. 4. FIG. 38 depicts additional details of light string 124*a*.

In an embodiment, and as described in part above, light string 124*a* includes first or lead wire 143 with terminal 141*a*, a plurality of lighting assemblies 142, a plurality of intermediate wires 145, last or return wire 147 with terminal 141*b*.

Each lighting assembly 142 includes lighting element 146 and lamp holder 149. Each lamp holder 151 may include lamp lock 151 which locks an adapter or base connected to lighting element 146 to lamp holder 151 so as to prevent lighting element 146 from being accidentally removed from lamp holder 151. Lamp lock device 151 may also serve to orient lighting element 146 to lamp holder 149, such that the electrical polarity of lighting element 146 matches the electrical polarity of lamp holder 149. In an embodiment, every lamp holder is a two-wire lamp holder in that the lamp holder is configured to receive not more than two wires. Such an embodiment is made possible with the single-wire construction, including a single-wire construction with a single series circuit.

Each intermediate wire at a first end is inserted into a lamp holder 149 to make an electrical connection to a lead of a lighting element 146, and at a second end is inserted into a another lamp holder 149 to make an electrical connection with another lighting element 146, as part of the series connection. As depicted, neither first wire 143 nor last wire 147 are twisted about intermediate wires 145. In an embodiment, and as depicted, single-wire light string 124*a* also does not include any other supporting strands woven about intermediate wires 145.

In an embodiment, neither first wire 143 nor last wire 147 are twisted or wrapped about any of the intermediate wires. In another embodiment, neither first wire 143 nor last wire 147 are twisted about all of the intermediate wires, but one of wire 143 or 147 may be twisted about some of the intermediate wires, which in an embodiment, means less than half of the intermediate wires 145.

Referring also to FIG. 37, terminals 141*a* and 141*b* may be connected to terminals 678*a* and 680*a* of wiring harness 604 so as to be electrically connected to a power source.

In an alternate embodiment, lead wires 143 and 147 are integrated into wiring harness subassembly 604. In such an embodiment, terminals 678*a* and 680*a* may comprise terminals of the type depicted as 141*a* and 141*b*. Terminals 141*a* and 141*b* may be terminals adapted to be received by a lamp holder 149. In such an embodiment, an electrical connection between an external portion of wiring harness 604 connects to light string 124*a* at a standard lamp holder 149, thereby avoiding the use of other types of connectors, including connectors at a trunk wall. In such an embodiment, first wire 143 is a wire of the wiring harness, and last wire 147 is also a wire of the wiring harness.

Figure 39:
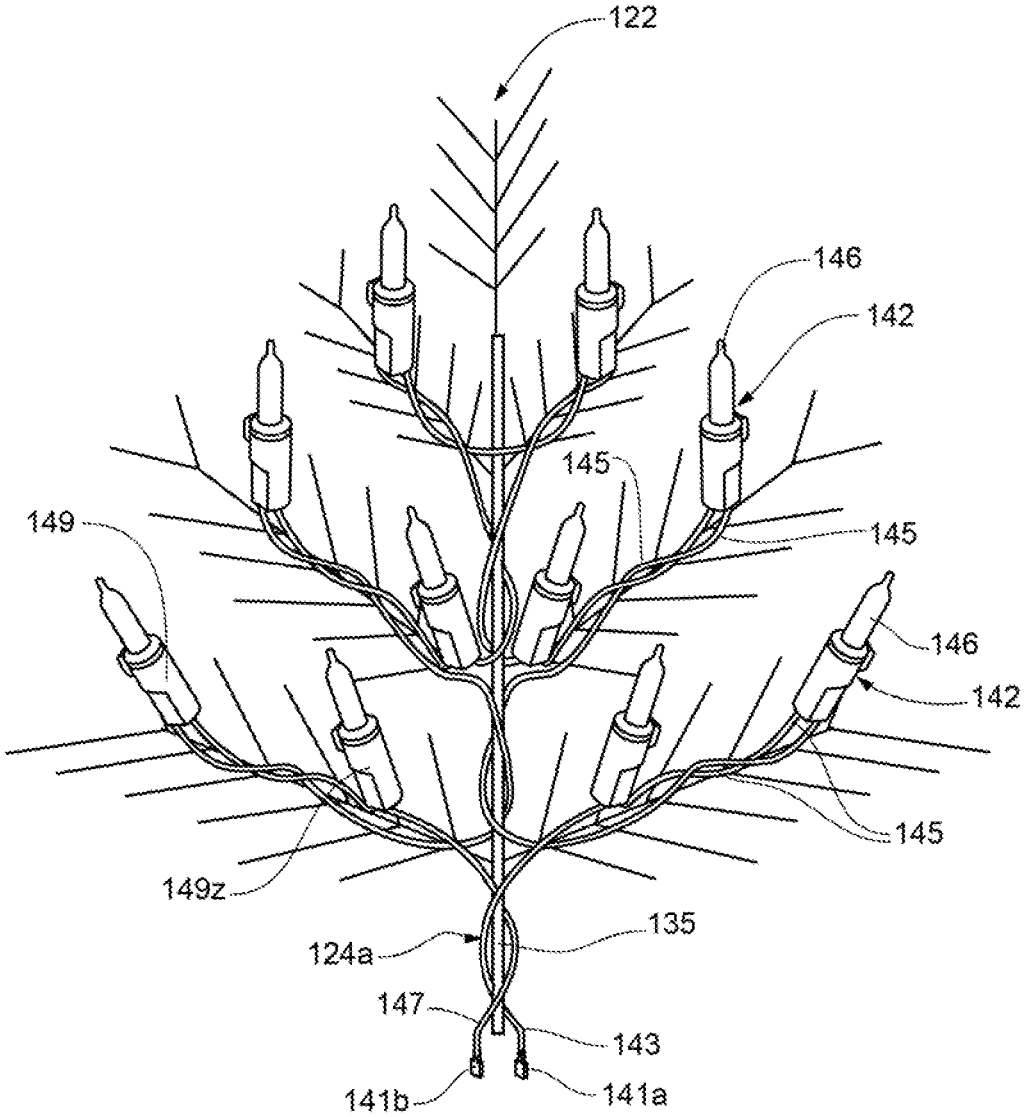
FIG. 39 depicts the light string of FIG. 38 as attached to a branch of the tree of FIG. 1, according to an embodiment of the claimed invention.

Referring to FIG. 39, light string 124*a* of the claimed invention is depicted as attached to a branch 122 and branch extension 130. Unlike a twisted pair light string 124 in which a return wire would be twisted with, and follow the intermediate wires 145 throughout the branch and branch extension, return wire 147 is twisted about a portion of branch frame 135 and terminates at last lamp holder 149*z*. Unlike a traditional twisted pair light string 124, intermediate wires 145 may be twisted about one another as shown (recalling that a traditional twisted pair light string twists intermediate wires with either a lead wire or a return wire). In other embodiments, intermediate wires 145 may not be twisted about one another. The resulting effect of not having a return wire 147 twisted about all intermediate wires 145 is that less overall wire may be used since a return wire of light string 124*a* will be shorter than a return wire that twists about all intermediate wires. Not only does this save in manufacturing costs, but also improves the aesthetic appearance of tree 100.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A modular artificial tree, comprising:

a first tree portion, the first tree portion including:

a first trunk body having a first end and a second end, a first plurality of branches assembled on the first trunk body via one or more first branch-support structures, a first electrical connector adjacent to the second end of the first trunk body, the first electrical connector including a first annular electrical terminal defining a first central opening, and a second electrical terminal defining a second central opening, the first and second annular electrical terminals being concentric about a central axis of the first electrical connector, a first plurality of power wires located at least partially within the first trunk body and electrically connected to the first electrical connector; and a first light string having a first set of lighting elements electrically connected to the first plurality of power wires, and a first set of light string wires, a portion of the first light string lighting elements and a portion of the first set of light string wires are distributed about, and affixed to, an external portion of the first plurality of branches;

a second tree portion, the second tree portion including:

a second trunk body having a first end and a second end, the first end configured to couple with the second end of the first trunk body of the first tree portion, a second plurality of branches assembled to the second trunk body via one or more second branch support structures, a second electrical connector positioned adjacent to the first end of the second trunk body, the second electrical connector configured to connect to the first electrical connector of the first trunk portion, the second electrical connector including a first electrical terminal and a second electrical terminal, each of the first electrical terminal and second electrical terminal radially displaced from a center of the second electrical connector;

a second plurality of power wires electrically connected to the second electrical connector, and a second light string having a second set of lighting elements electrically connected to the second plurality of power wires and distributed about, and affixed to, an external portion of the second plurality of branches; and wherein the first trunk body and the second trunk body are configured to mechanically couple with one another in any rotational alignment, and the first electrical connector and the second electrical connector are configured to mechanically couple and electrically connect in any of a plurality of rotational alignments, such that mechanical coupling of the first trunk body with the second trunk body, and the mechanical coupling, and the electrical connecting, of the first electrical connector with the second electrical connector causes the first tree portion to be mechanically coupled and electrically connected with the second tree portion.

2. The modular artificial tree of claim 1, wherein the second tree portion further comprises a third light string having a third set of lighting elements, the third light string connected to the second light string so as to form an extension of the second light string.

3. The modular artificial tree of claim 1, wherein the portion of the first set of light string wires is wrapped around the first plurality of branches to affix the portion of the first set of light string wires to the first plurality of branches, and the portion of the second set of light string wires is wrapped about the second plurality of branches to affix the portion of the second set of light string wires to the second plurality of branches.

4. The modular artificial tree of claim 1, wherein the portion of the first set of light string wires is affixed to the first plurality of branches via a first set of clips, and the portion of the second set of light string wires is affixed to the second plurality of via a second set of clips.

5. The modular artificial tree of claim 1, wherein the branch support structures comprise branch support rings.

6. The modular artificial tree of claim 1, wherein the first tree portion is an upper tree portion and the second tree portion is a lower tree portion.

7. The modular artificial tree of claim 1, wherein the first tree portion is a lower tree portion and the second tree portion is an upper tree portion.

8. The modular artificial tree of claim 1, wherein the second electrical terminal of the second electrical connector is radially displaced further from the center of the second electrical connector as compared to the first electrical terminal of the second electrical connector.

9. The modular artificial tree of claim 1, wherein the first and second terminals of the second electrical connector comprise blade-like terminals.

10. The modular artificial tree of claim 1, wherein the first electrical connector is completely within an inside cavity of the first trunk body, and the second electrical connector is completely within an inside cavity of the second trunk body.

11. The modular artificial tree of claim 1, wherein the first light string includes a string-like portion intertwined with the first set of light string wires of the first light string, the string-like portion improving a pull strength of the first light string.

12. A modular artificial tree, comprising:

a first tree portion, the first tree portion including:

a first trunk body having a first end and a second end, a first plurality of branches pivotally coupled to the first trunk body via one or more first branch-support structures, a first electrical connector adjacent to the second end of the first trunk body, the first electrical connector including a first annular electrical terminal defining a first central opening, and a second electrical terminal defining a second central opening, the first and second annular electrical terminals being concentric about a central axis of the first electrical connector, a first plurality of power wires located at least partially within the first trunk body and electrically connected to the first electrical connector; and a first light string having a first set of lighting elements electrically connected to the first plurality of power wires, and a first set of light string wires, a portion of the first light string lighting elements and a portion of the first set of light string wires are distributed about an external portion of the first plurality of branches;

a second tree portion, the second tree portion including:

a second trunk body having a first end and a second end, the first end configured to couple with the second end of the first trunk body of the first tree portion, a second plurality of branches pivotally coupled to the second trunk body via one or more second branch support structures, a second electrical connector positioned adjacent to the first end of the second trunk body, the second electrical connector configured to connect to the first electrical connector of the first trunk portion, the second electrical connector including a first electrical terminal and a second electrical terminal, each of the first electrical terminal and second electrical terminal radially displaced from a center of the second electrical connector;

a second plurality of power wires electrically connected to the second electrical connector, and a second light string having a second set of lighting elements electrically connected to the second plurality of power wires and distributed about an external portion of the second plurality of branches; and wherein the first trunk body and the second trunk body are configured to mechanically couple with one another in any rotational alignment, and the first electrical connector and the second electrical connector are configured to mechanically couple, and electrically connect, in any of a plurality of rotational alignments, such that mechanical coupling of the first trunk body with the second trunk body, and the mechanical coupling, and the electrical connecting, of the first electrical connector with the second electrical connector causes the first tree portion to be mechanically coupled and electrically connected with the second tree portion.

13. The modular artificial tree of claim 12, wherein the second tree portion further comprises a third light string having a third set of lighting elements, the third light string connected to the second light string so as to form an extension of the second light string.

14. The modular artificial tree of claim 12, wherein the branch support structures comprise branch support rings.

15. The modular artificial tree of claim 12, wherein the first tree portion is a lower tree portion and the second tree portion is an upper tree portion.

16. The modular artificial tree of claim 12, wherein the second electrical terminal of the second electrical connector is radially displaced further from the center of the second electrical connector as compared to the first electrical terminal of the second electrical connector.

17. The modular artificial tree of claim 12, wherein the first and second terminals of the second electrical connector comprise blade-like terminals.

18. The modular artificial tree of claim 12, wherein the first electrical connector is completely within an inside cavity of the first trunk body, and the second electrical connector is completely within an inside cavity of the second trunk body.

19. The modular artificial tree of claim 12, wherein the first light string includes a string-like portion intertwined with the first set of light string wires of the first light string, the string-like portion improving a pull strength of the first light string.

20. A modular artificial tree, comprising:

a first tree portion, the first tree portion including:

a first trunk body having a first end and a second end, a first plurality of branches coupled to the first trunk body via one or more first branch-support structures, a first electrical connector adjacent to the second end of the first trunk body, the first electrical connector including a first annular electrical terminal defining a first central opening, and a second electrical terminal defining a second central opening, the first and second annular electrical terminals being concentric about a central axis of the first electrical connector, a first plurality of power wires located at least partially within the first trunk body and electrically connected to the first electrical connector; and a first light string having a first set of lighting elements electrically connected to the first plurality of power wires, and a first set of light string wires, a portion of the first light string lighting elements and a portion of the first set of light string wires are distributed about an external portion of the first plurality of branches;

a second tree portion, the second tree portion including:

a second trunk body having a first end and a second end, the first end configured to couple with the second end of the first trunk body of the first tree portion, a second plurality of branches coupled to the second trunk body via one or more second branch support structures, a second electrical connector positioned adjacent to the first end of the second trunk body, the second electrical connector configured to connect to the first electrical connector of the first trunk portion, thereby electrically connecting the first tree portion and the second tree portion when the first trunk portion and the second trunk portion are coupled together, the second electrical connector including a first electrical terminal and a second electrical terminal, each of the first electrical terminal and second electrical terminal radially displaced from a center of the second electrical connector;

a second plurality of power wires electrically connected to the second electrical connector, and a second light string having a second set of lighting elements electrically connected to the second plurality of power wires and distributed about an external portion of the second plurality of branches; and wherein the first trunk body and the second trunk body are configured to mechanically couple with one another in any rotational alignment, and the first electrical connector and the second electrical connector are configured to mechanically couple and electrically connect in any rotational alignment, such that mechanical coupling of the first trunk body with the second trunk body, and the mechanical coupling and electrical connecting of the first electrical connector with the second electrical connector causes the first tree portion to be mechanically coupled and electrically connected with the second tree portion.

21. The modular artificial tree of claim 20, wherein the second tree portion further comprises a third light string having a third set of lighting elements, the third light string connected to the second light string so as to form an extension of the second light string.

22. The modular artificial tree of claim 20, wherein the branch support structures comprise branch support rings.

23. The modular artificial tree of claim 20, wherein the first tree portion is a lower tree portion and the second tree portion is an upper tree portion.

24. The modular artificial tree of claim 20, wherein the second electrical terminal of the second electrical connector is radially displaced further from the center of the second electrical connector as compared to the first electrical terminal of the second electrical connector.

25. The modular artificial tree of claim 20, wherein the first and second terminals of the second electrical connector comprise blade-like terminals.

26. The modular artificial tree of claim 20, wherein the first electrical connector is completely within an inside cavity of the first trunk body, and the second electrical connector is completely within an inside cavity of the second trunk body.

27. The modular artificial tree of claim 20, wherein the first light string includes a string-like portion intertwined with the first set of light string wires of the first light string, the string-like portion improving a pull strength of the first light string.

* * * * *